US011594826B2

(12) United States Patent
Sakoda

(10) Patent No.: US 11,594,826 B2
(45) Date of Patent: Feb. 28, 2023

(54) CABLE CONNECTOR INCLUDING CABLE HOLDER, AND METHOD OF MANUFACTURING CABLE CONNECTOR

(71) Applicant: HIROSE ELECTRIC CO., LTD., Kanagawa (JP)

(72) Inventor: Yusuke Sakoda, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 139 days.

(21) Appl. No.: 17/199,591

(22) Filed: Mar. 12, 2021

(65) Prior Publication Data

US 2021/0305724 A1 Sep. 30, 2021

(30) Foreign Application Priority Data

Mar. 24, 2020 (JP) ..... JP2020-052372

(51) Int. Cl.
*H01R 4/2433* (2018.01)
*H01R 43/18* (2006.01)
(Continued)

(52) U.S. Cl.
CPC ..... *H01R 4/2433* (2013.01); *H01R 13/405* (2013.01); *H01R 13/502* (2013.01); *H01R 43/18* (2013.01)

(58) Field of Classification Search
None
See application file for complete search history.

(56) References Cited

U.S. PATENT DOCUMENTS 5,378,176 A * 1/1995 Sasai ..... H01R 13/4362 439/752
5,501,619 A * 3/1996 Sakatani ..... H01R 13/4362 439/752

(Continued)

FOREIGN PATENT DOCUMENTS

WO 2018/016389 A1 1/2018

*Primary Examiner* — Oscar C Jimenez
(74) *Attorney, Agent, or Firm* — Rankin, Hill & Clark LLP

(57) ABSTRACT

Provided is a cable connector which includes: a housing; and a cable holder capable of holding one end side of the cable. The cable holder includes at least three first to third engagement portions on each of opposing outer side surfaces, in a direction along a lead-out direction where the cable held on the one end side by the cable holder is led out from the cable holder, the first engagement portion is placed on a side far from the cable lead-out side of the cable holder, the second engagement portion is placed on a side near the lead-out side, and the third engagement portion is placed between the first engagement portion and the second engagement portion, the housing includes at least three first to third corresponding engagement portions capable of engaging respectively with the first to third engagement portions, on each of opposing inner side surfaces, it is configured in such a manner that, upon the first to third engagement portions engaging with the first to third corresponding engagement portions, respectively, the cable holder is capable of being placed at least at a first engagement position and a second engagement position with respect to the housing, at the first engagement position, the first and second engagement portions are in engagement with the first and second corresponding engagement portions, respectively, while the third engagement portion has not yet engaged with the third corresponding engagement portion, and at the second engagement position, all the first to third engagement por- (Continued)

tions are in engagement with the first to third corresponding engagement portions, respectively.

13 Claims, 20 Drawing Sheets

(51) Int. Cl.
*H01R 13/405* (2006.01)
*H01R 13/502* (2006.01)

(56) References Cited

U.S. PATENT DOCUMENTS

| | | | | | |
|---|---|---|---|---|---|
| 5,643,009 | A * | 7/1997 | Dinkel | H01R 13/424 | 439/752 |
| 5,647,777 | A * | 7/1997 | Sasai | H01R 43/18 | 439/752 |
| 5,865,653 | A * | 2/1999 | Okada | H01R 13/4362 | 439/752 |
| 6,328,613 | B1 * | 12/2001 | Kashiyama | H01R 13/4362 | 439/752 |
| 2001/0005657 | A1 * | 6/2001 | Kashiyama | H01R 13/4362 | 439/752 |
| 2004/0192118 | A1 * | 9/2004 | Sakurai | H01R 13/4362 | 439/752 |
| 2018/0131146 | A1 * | 5/2018 | Larsson | H01R 43/01 | |
| 2019/0229438 | A1 * | 7/2019 | Naganuma | H01R 13/506 | |
| 2019/0237898 | A1 | 8/2019 | Naganuma | | |

* cited by examiner

CABLE CONNECTOR INCLUDING CABLE HOLDER, AND METHOD OF MANUFACTURING CABLE CONNECTOR

CROSS-REFERENCE TO RELATED APPLICATION

This application claims priority from Japanese Patent Application No. 2020-052372 filed with the Japan Patent Office on Mar. 24, 2020, the entire content of which is hereby incorporated by reference.

BACKGROUND

1. Technical Field

The present disclosure relates to a cable connector including a cable holder, and a method of manufacturing the cable holder.

2. Related Art

WO 18/016389 A presents an example of an electrical connector apparatus including a known cable connector. FIGS. 21 to 25 illustrate a part of the drawings disclosed in WO 18/016389 A.

FIG. 21 is a perspective view illustrating a known cable connector including a cable holder and an electrical connector apparatus including them. FIG. 21 also illustrates an electrical cable and a board. An electrical connector apparatus 1 includes a pair of a cable connector 10 and a counterpart connector 90.

The cable connector 10 is mated to, or removed from, the board connector 90 along a direction of an arrow "a" illustrated. When the cable connector 10 and the board connector 90 have been mated to each other, a tapered mated portion 50*a* of a shell of the cable connector 10 is inserted into a substantially rectangular mating hole 97 in a front surface of the board connector 90. Lock protruding portions 35 protruding elastically from upper and lower sides of the distal end portion 50*a* of the cable connector 10 are fitted into through-holes 99 in a ceiling portion and a base plate portion of a shell 98 of the board connector 90.

FIG. 22 illustrates an exploded perspective view of the cable connector 10 together with a twisted pair cable 5. A hood 12 and a jacket of an electrical cable 4, which are illustrated in FIG. 21, have been removed in FIG. 22. The cable connector 10 further includes a housing 20 made of an insulating member such as resin, and a conductive shell 30 in addition to the insulating hood 12 (refer to FIG. 21) that covers an outer peripheral surface of the shell 30. The conductive shell 30 covers an outer peripheral surface of, for example, terminal supporters 70 that support terminals 11 made of an insulating member such as resin as the housing 20, cable holders 60 that hold the cable 5, and the housing 20.

FIG. 23 is an exploded perspective view of the housing 20, the terminal supporters 70, and the cable holders 60, which are components of the cable connector 10 illustrated in FIG. 22. FIG. 23 also illustrates the twisted pair cable 5.

The housing 20 includes a main body 29 and an inserted portion 25 protruding from the main body 29. The inserted portion 25 is mated to, or removed from, the board connector 90. The main body 29 includes a thick base portion 21, and two plate-shaped side walls 26 that extend rearward of the base portion 21 and face each other. The paired terminal supporters 70 and the similarly paired cable holders 60 are mounted in a space 26*f* defined by the plate-shaped side walls 26.

The cable holder 60 mainly includes a substantially cuboid main body 67, and a cantilevered arm portion 61 extending from an undersurface 67*b* of the main body 67 in a direction "γ1" or "γ2" where the cable holder 60 is mounted on the housing 20.

Each of left and right side surfaces 67*c* and 67*d* of the main body 67 is provided with a latch protruding portion 62 that latches in a corresponding engagement portion (latch hole) 26*a* provided in the plate-shaped side wall 26 of the housing 20. Moreover, a latch protruding portion 61*a* that is latched to a latch protruding portion 75*a* provided on a vertically arranged portion 75 of the terminal supporter 70 is provided near a free end of the arm portion 61. The latch protruding portions 62 of the cable holder 60 and the latch holes 26*a* on the housing 20 side, and similarly, the latch protruding portion 61*a* of the cable holder 60 and the latch protruding portion 75*a* of the terminal supporter 70 are provided along the direction "γ1" or "γ2" where the cable holder 60 is mounted on the housing 20. These latch means are used to enable latching of the cable holder 60 to the housing 20.

FIGS. 24 and 25 explain a method of mounting the cable holders 60 on the housing 20.

FIG. 24 is a side view illustrating the cable holders 60 at a temporary fixing position with respect to the housing 20. When the cable holder 60 is at the temporary fixing position, the latch protruding portions 61*a* and 62 of the cable holder 60 and the corresponding latch portions 75*a* and 26*a* on the housing 20 side have not yet latched to each other. On the other hand, FIG. 25 is a side view illustrating the cable holders 60 at a latching completed position with respect to the housing 20. When the cable holder 60 is at the latching completed position, the latch protruding portions 61*a* and 62 of the cable holder 60 and the corresponding latch portions 75*a* and 26*a* on the housing 20 side have already been latched to each other.

When the cable holder 60 is mounted on the terminal supporter 70 or the housing 20, the cable holder 60 is positioned at the temporary fixing position illustrated in FIG. 24 before the cable holder 60 is actually latched and fixed. Tapers of the latch protruding portions 61*a* and 62 provided on the cable holder 60 collide respectively with the latch protruding portion 75*a* of the vertically arranged portion 75 of the terminal supporter 70 and an upper edge 26*d* of the plate-shaped side wall 26, which are parts of the housing 20 side, at the temporary fixing position. As a result, the cable holder 60 is positioned, spaced further apart from the housing 20 in the mounting direction "γ1" or "γ2" than when the cable holder 60 is at the latching completed position.

After being positioned at the temporary fixing position illustrated in FIG. 24, a force of simultaneously gripping the paired opposing cable holders 60 can be applied at one time to, for example, top surfaces 67*a* of the cable holders 60, by use of, for example, fingertips or a jig. Consequently, it is possible to mount the cable holders 60 on, for example, the housing 20 at a time.

As illustrated in FIG. 25, at the latching completed position, the latch protruding portion 61*a* provided to the arm portion 61 of the cable holder 60 moves over the latch protruding portion 75*a* provided to the vertically arranged portion 75 of the terminal supporter 70, and is latched thereto. Moreover, the latch protruding portions 62 provided to the side surfaces 67*c* and 67*d* of the main body 67 of the cable holder 60 move over the upper edges 26*d* of the plate-shaped side walls 26 of the housing 20, and are fitted into the latch holes 26*a*. Moreover, at this point in time, a protruding portion 66 provided on the cable holder 60 is placed in such a manner as to be near the counterpart cable holder through a notch 76 provided in the terminal supporter 70.

Furthermore, when the cable holder 60 moves from the temporary fixing position illustrated in FIG. 24 to the latching completed position illustrated in FIG. 25, the twisted pair cable 5 held by the cable holder 60 can be connected to a cable pressure-welding portion 11*b* of the terminal 11 by use of the force applied to mount the cable holder 60 on the housing 20.

SUMMARY

A cable connector according to an embodiment includes: a housing; and a cable holder capable of holding one end side of the cable, in which the cable holder includes at least three first to third engagement portions on each of opposing outer side surfaces, in a direction along a lead-out direction where the cable held on the one end side by the cable holder is led out from the cable holder, the first engagement portion is placed on a side far from the cable lead-out side of the cable holder, the second engagement portion is placed on a side near the lead-out side, and the third engagement portion is placed between the first engagement portion and the second engagement portion, the housing includes at least three first to third corresponding engagement portions capable of engaging respectively with the first to third engagement portions, on each of opposing inner side surfaces, it is configured in such a manner that, upon the first to third engagement portions engaging with the first to third corresponding engagement portions, respectively, the cable holder is capable of being placed at least at a first engagement position and a second engagement position with respect to the housing, at the first engagement position, the first and second engagement portions are in engagement with the first and second corresponding engagement portions, respectively, while the third engagement portion has not yet engaged with the third corresponding engagement portion, and at the second engagement position, all the first to third engagement portions are in engagement with the first to third corresponding engagement portions, respectively.

DETAILED DESCRIPTION

Figure 1:
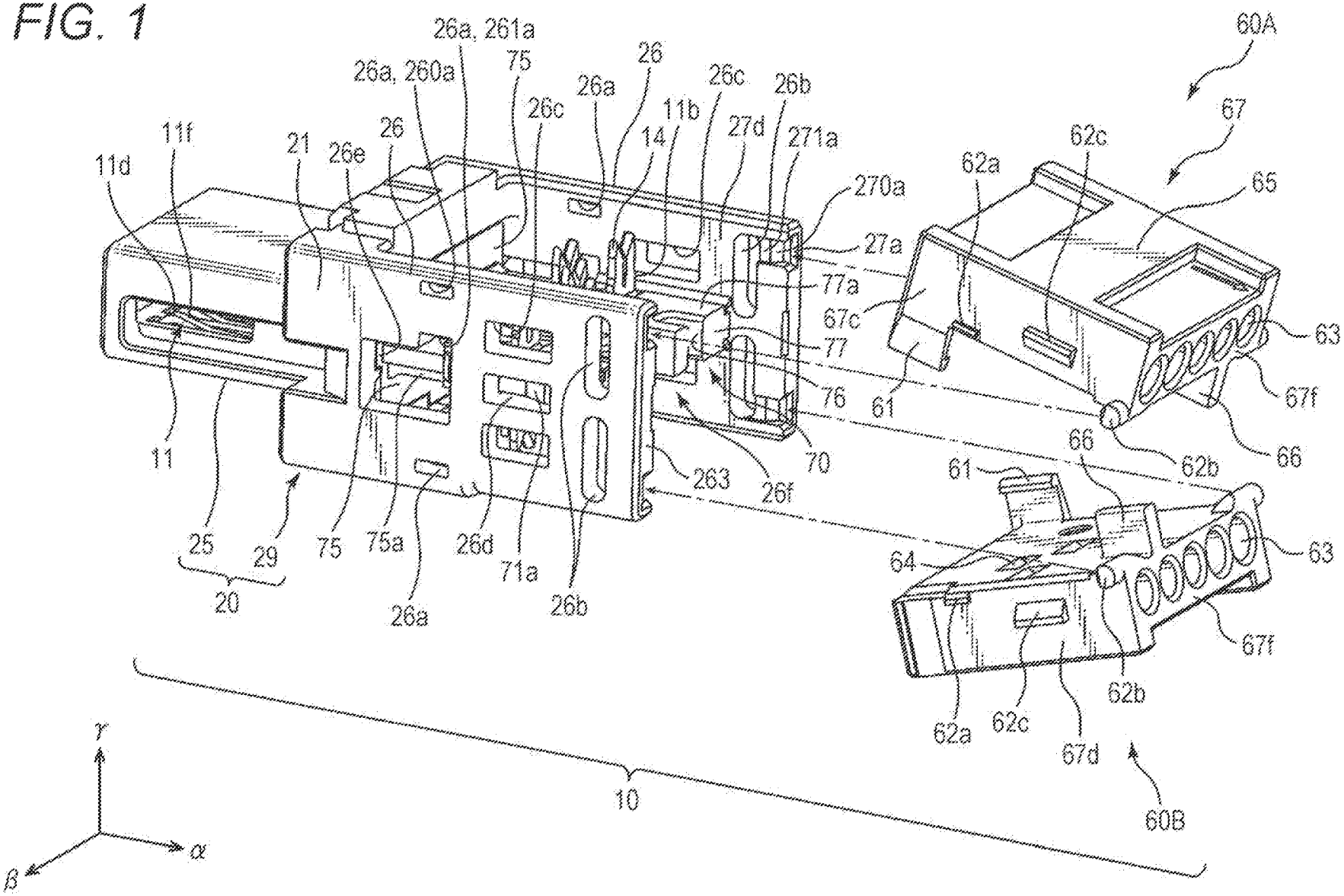
FIG. 1 is a perspective view of a housing, a terminal supporter, and cable holders as components of a cable connector according to one embodiment of the present disclosure as viewed from above.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As is clear from FIGS. 21 to 25, in a known cable connector 10, the following operations are required to complete the cable connector 10 where a cable 5 has been mounted. Firstly, one end of the cable 5 is held by a cable holder 60 provided independently, in a state separated from the housing 20. The cable holder 60 holding the cable 5 is mounted at a temporary fixing position of the housing 20 as it is. Furthermore, the cable holder 60 is pressed against the housing 20 by use of, for example, a jig.

However, at the temporary fixing position, a latch protruding portion 62 of the cable holder 60 has not yet latched in a latch hole 26*a* on the housing 20 side, and tapers of a latch protruding portion 61*a* and the latch protruding portion 62, which are provided on the cable holder 60, are simply colliding respectively with a latch protruding portion 75*a* provided to a vertically arranged portion 75 of a terminal supporter 70 and an upper edge 26*d* of a plate-shaped side wall 26, which are part of the housing 20 side. Hence, this state is not always stable. Hence, there is a small problem in usability.

Moreover, the mounting of the cable holder 60 at the temporary fixing position of the housing 20 in the as-is state after the one end of the cable 5 is held by the cable holder 60 is slightly complicated. For example, a force is applied to the cable holder 60 mounted at the temporary fixing position of the housing 20 through the cable 5 extending out from the cable holder 60. Consequently, the cable holder 60 easily comes off at the temporary fixing position of the housing 20. Such a problem is becoming more serious with reducing size of the apparatus.

An object of the present disclosure is to provide a cable connector that has solved the above drawbacks and a method of manufacturing the cable connector.

In order to solve the problem described above, a cable connector according to an aspect of the present disclosure includes: a housing; and a cable holder capable of holding one end side of the cable, in which the cable holder includes at least three first to third engagement portions on each of opposing outer side surfaces, in a direction along a lead-out direction where the cable held on the one end side by the cable holder is led out from the cable holder, the first engagement portion is placed on a side far from the cable lead-out side of the cable holder, the second engagement portion is placed on a side near the lead-out side, and the third engagement portion is placed between the first engagement portion and the second engagement portion, the housing includes at least three first to third corresponding engagement portions capable of engaging respectively with the first to third engagement portions, on each of opposing inner side surfaces, it is configured in such a manner that, upon the first to third engagement portions engaging with the first to third corresponding engagement portions, respectively, the cable holder is capable of being placed at least at a first engagement position and a second engagement position with respect to the housing, at the first engagement position, the first and second engagement portions are in engagement with the first and second corresponding engagement portions, respectively, while the third engagement portion has not yet engaged with the third corresponding engagement portion, and at the second engagement position, all the first to third engagement portions are in engagement with the first to third corresponding engagement portions, respectively.

According to, for example, the cable connector of this aspect, for example, a shipping operation can be performed in a state where the cable holder is previously placed at the first position of the housing. Accordingly, it is possible to stabilize the state of the cable holder with respect to the housing and to facilitate subsequent operations by a user. As a result, it is possible to improve usability for the user and enhance the simplification of the operations.

Further, a method of manufacturing a cable connector according to an aspect of the present disclosure is a method of manufacturing a cable connector by mounting, on a housing, a cable holder capable of holding one end side of a cable. In this method, the cable holder includes at least three first to third engagement portions on each of opposing outer side surfaces, in a direction along a lead-out direction where the cable held on the one end side by the cable holder is led out from the cable holder, the first engagement portion is placed on a side far from the cable lead-out side of the cable holder, the second engagement portion is placed on a side near the lead-out side, and the third engagement portion is placed between the first engagement portion and the second engagement portion, the housing includes at least three first to third corresponding engagement portions capable of engaging respectively with the first to third engagement portions, on each of opposing inner side surfaces, it is configured in such a manner that, upon the first to third engagement portions engaging with the first to third corresponding engagement portions, respectively, the cable holder is located with respect to the housing at least at a first engagement position where the first and second engagement portions are in engagement with the first and second corresponding engagement portions, respectively, while the third engagement portion has not yet engaged with the third corresponding engagement portion, and at a second engagement position where all the first to third engagement portions are in engagement with the first to third corresponding engagement portions, and the method includes: moving the cable holder along a direction crossing a direction along an engagement direction from the first engagement position to the second engagement position with respect to the housing in a state where the second engagement portion is in engagement with the second corresponding engagement portion in such a manner that an angle formed by the direction along the lead-out direction and the direction along the engagement direction maintains an acute angle or a right angle; rotating the cable holder about the second engagement portion with respect to the housing and accordingly locating the cable holder at the first engagement position; and then pressing the cable holder against the housing and accordingly locating the cable holder at the second engagement position.

According to the present disclosure, it is possible to provide a cable connector that has solved the above drawbacks and also a method of manufacturing the cable connector.

A cable connector according to a preferred embodiment of the present disclosure and an electrical connector apparatus including the same are described hereinafter with reference to the accompanying drawings. Only the preferred embodiment of the present disclosure is illustrated here. However, naturally, it is not intended to limit the present disclosure. In the embodiment, for example, a twisted pair cable is used. However, as is clear from the following description, what is used is not limited to a twisted pair cable. For example, cables including a solid cable and a stranded cable can also be used.

Figure 21:
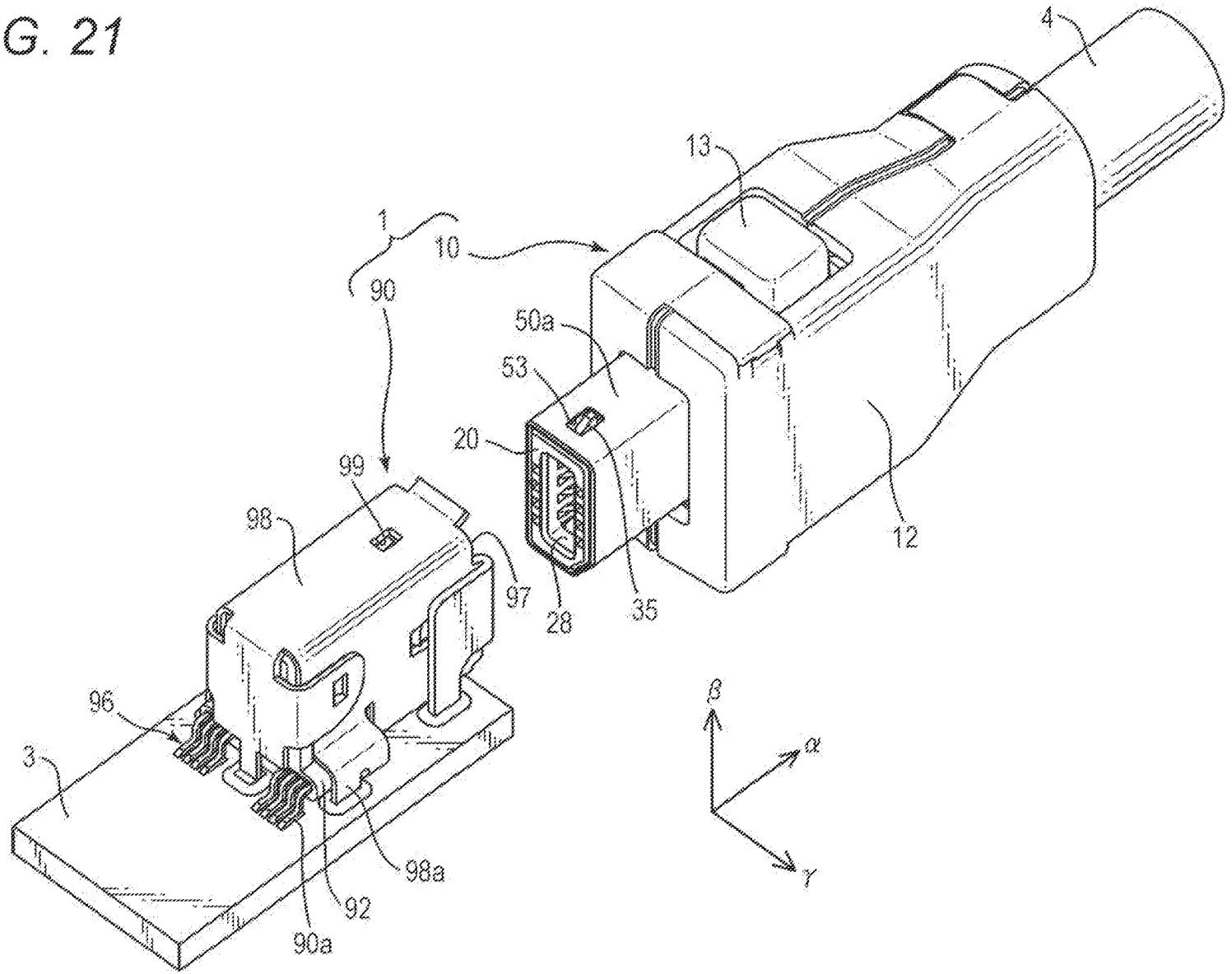
FIG. 21 is a perspective view of a known electrical connector apparatus.
Figure 22:
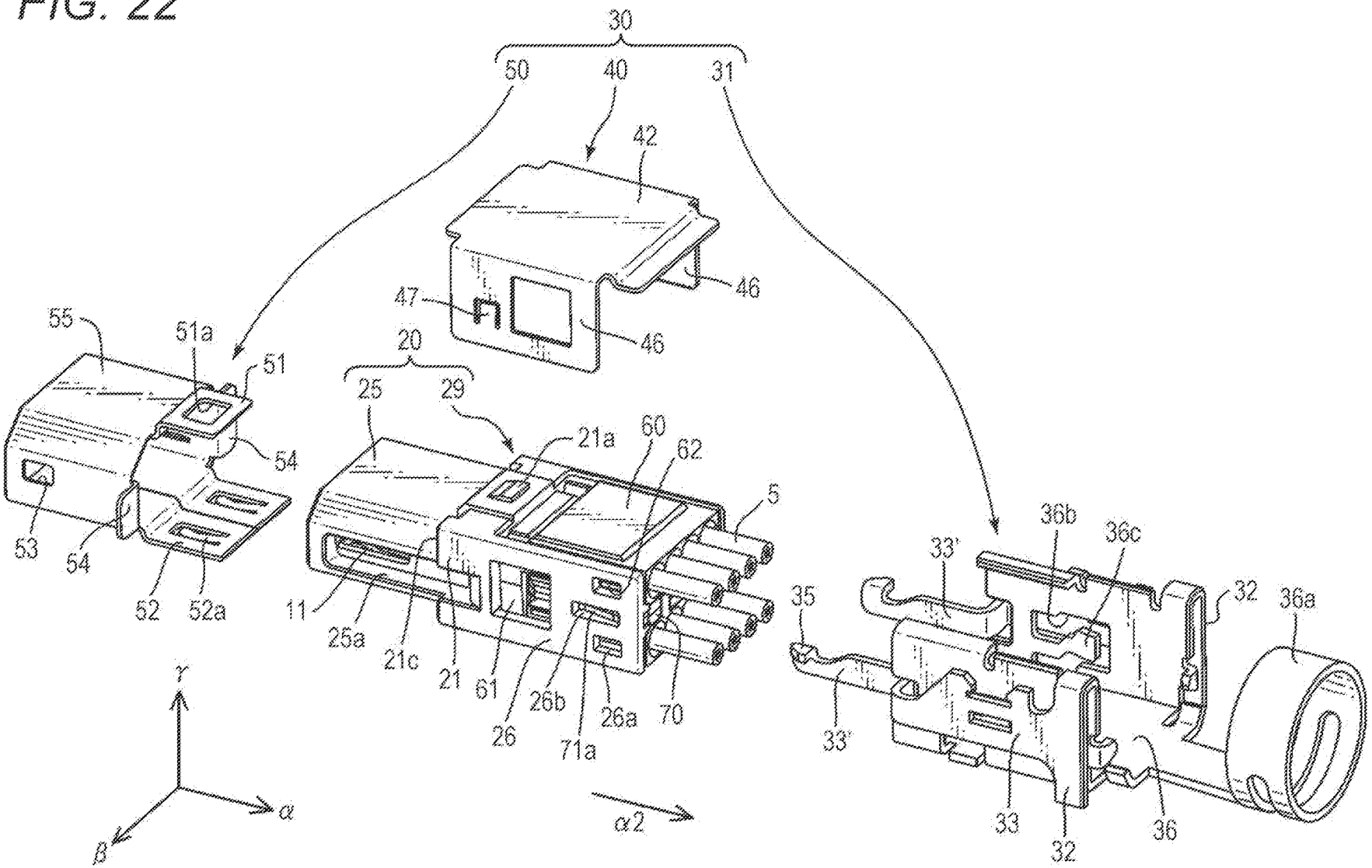
FIG. 22 is an exploded perspective view of a part of components of the electrical connector apparatus illustrated in FIG. 21.
Figure 23:
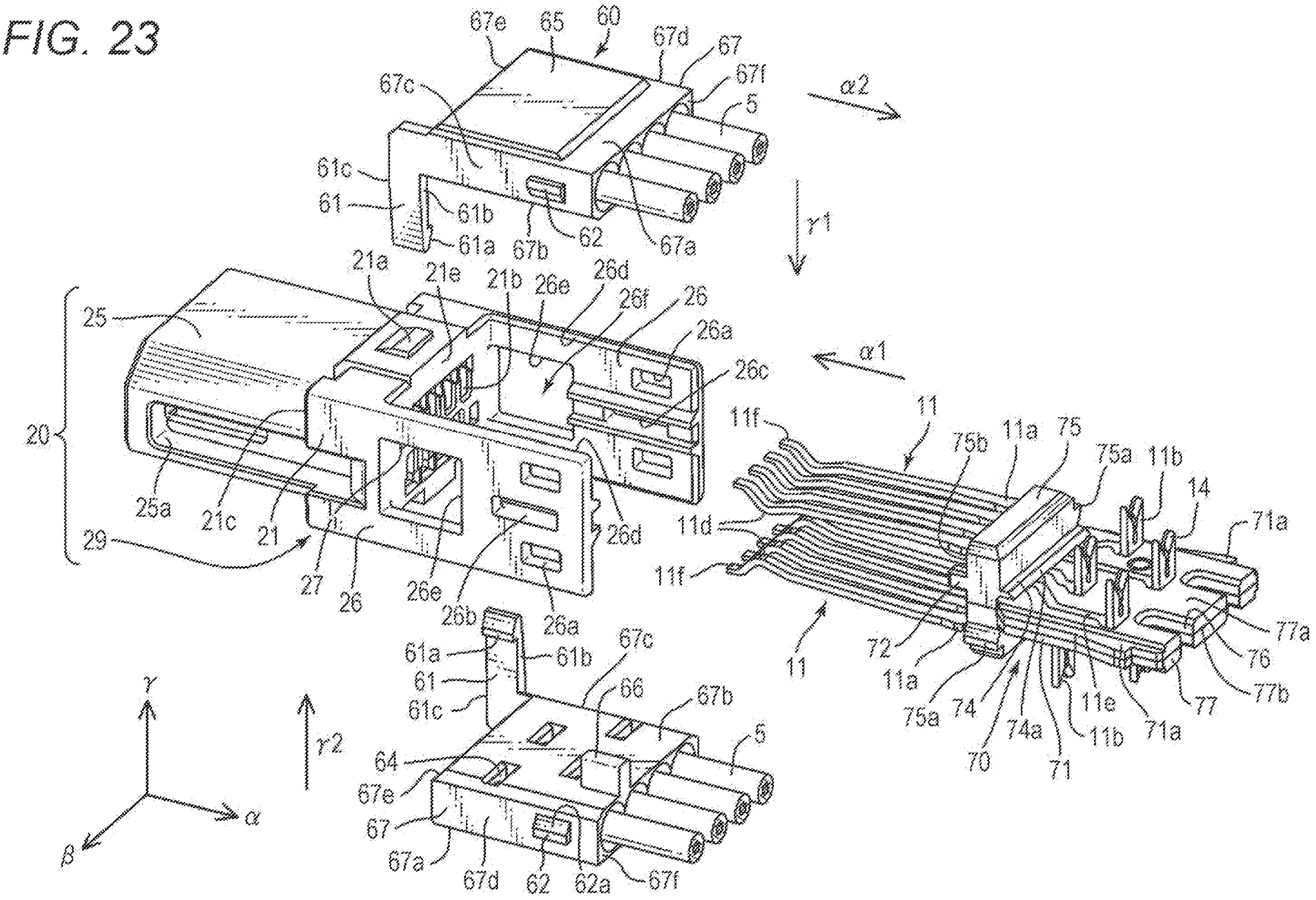
FIG. 23 is an exploded perspective view of a part of the components of a cable connector of the electrical connector apparatus illustrated in FIG. 22.
Figure 24:
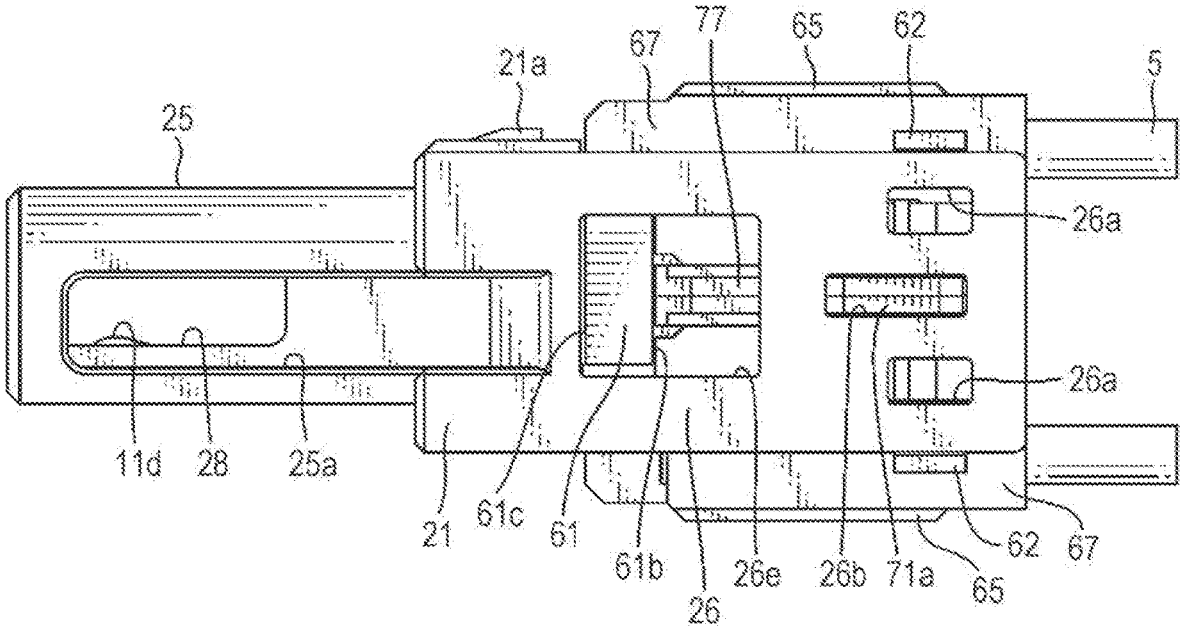
FIG. 24 is a side view explaining a method of mounting cable holders on a housing in the cable connector illustrated in FIG. 23, and illustrates the cable holders at a temporary fixing position with respect to the housing.
Figure 25:
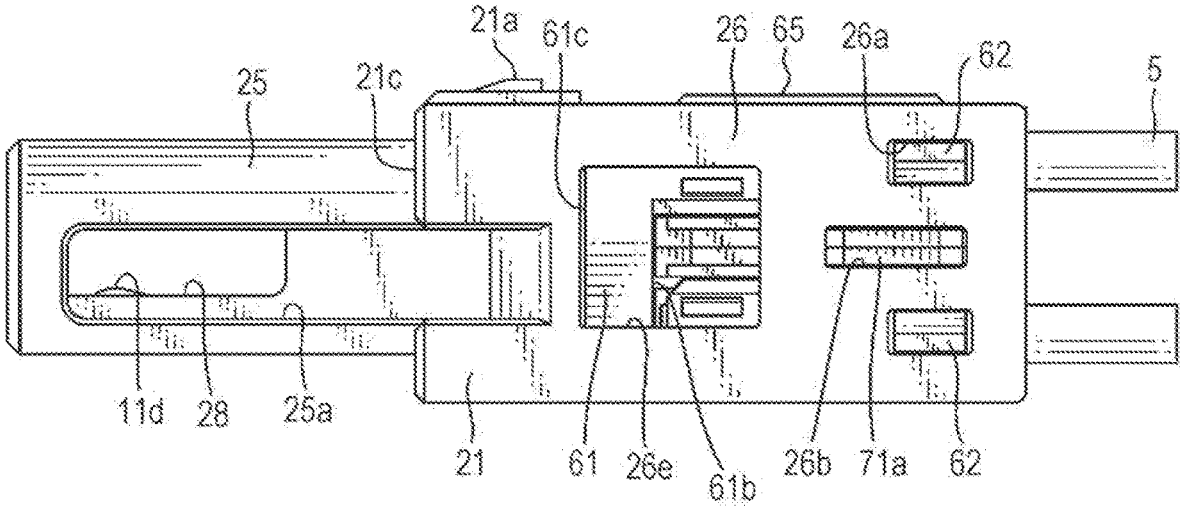
FIG. 25 is a side view explaining a method of mounting the cable holders on the housing in the cable connector illustrated in FIG. 23, and illustrates the cable holders at a latching completed position with respect to the housing.

In the embodiment, improvements are added to the components of the known cable connector 10 illustrated in, for example, FIG. 21, particularly to the configurations of the housing 20 and the cable holder 60. A description is given below, focusing on the configurations of these components. Matters that are not particularly described can also be considered similarly to WO 18/016389 A. However, naturally, it is not intended to be limited to the configurations disclosed in WO 18/016389 A. In other words, a housing 20 and a cable holder 60 of the present disclosure can be applied to the configurations disclosed in WO 18/016389 A, but, naturally, can also be applied to configurations other than them.

Figure 2:
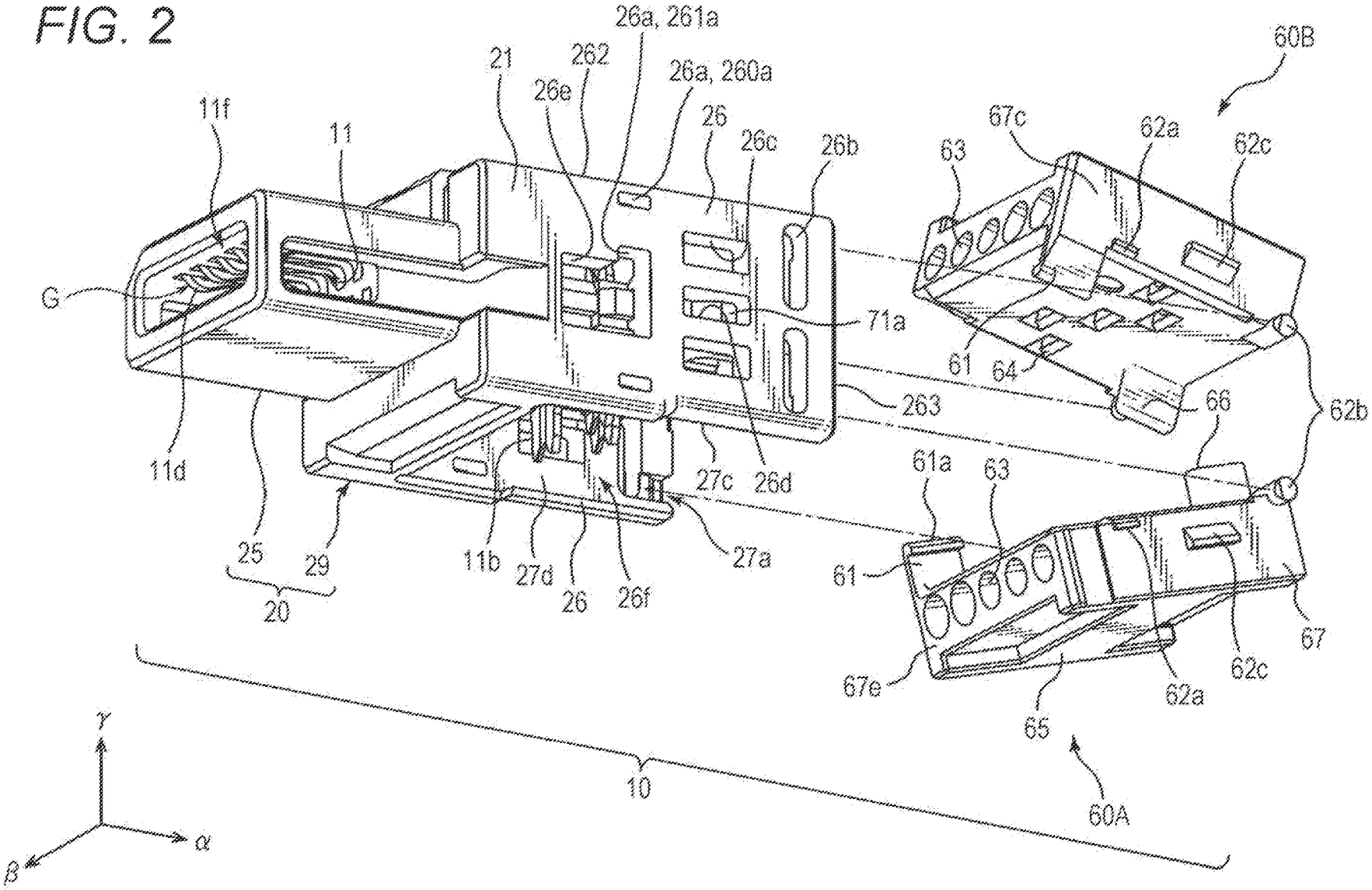
FIG. 2 is a perspective view of the components of FIG. 1 as viewed from below.
Figure 3:
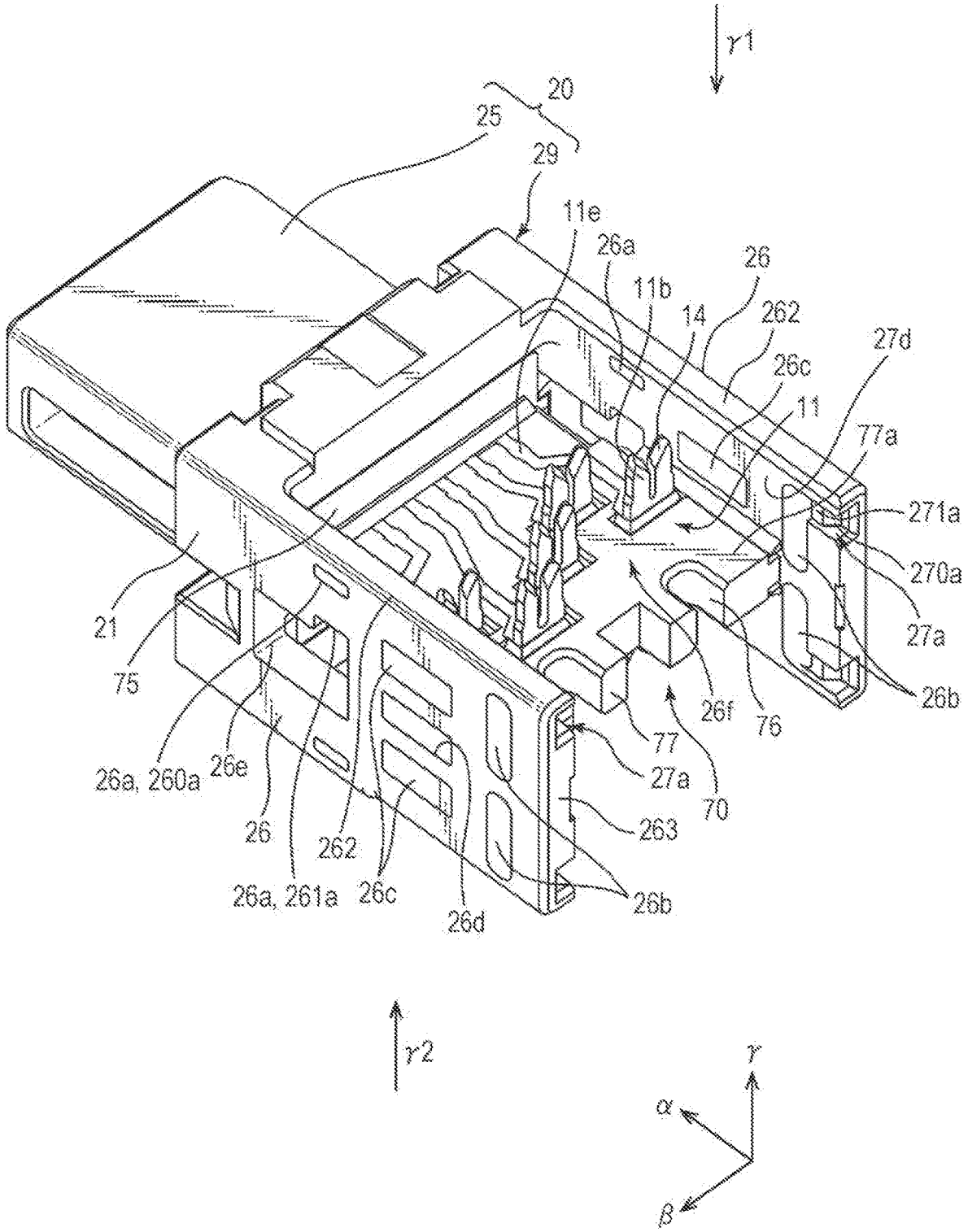
FIG. 3 is a perspective view of the components of FIG. 1 as viewed from a different angle.
Figure 4:
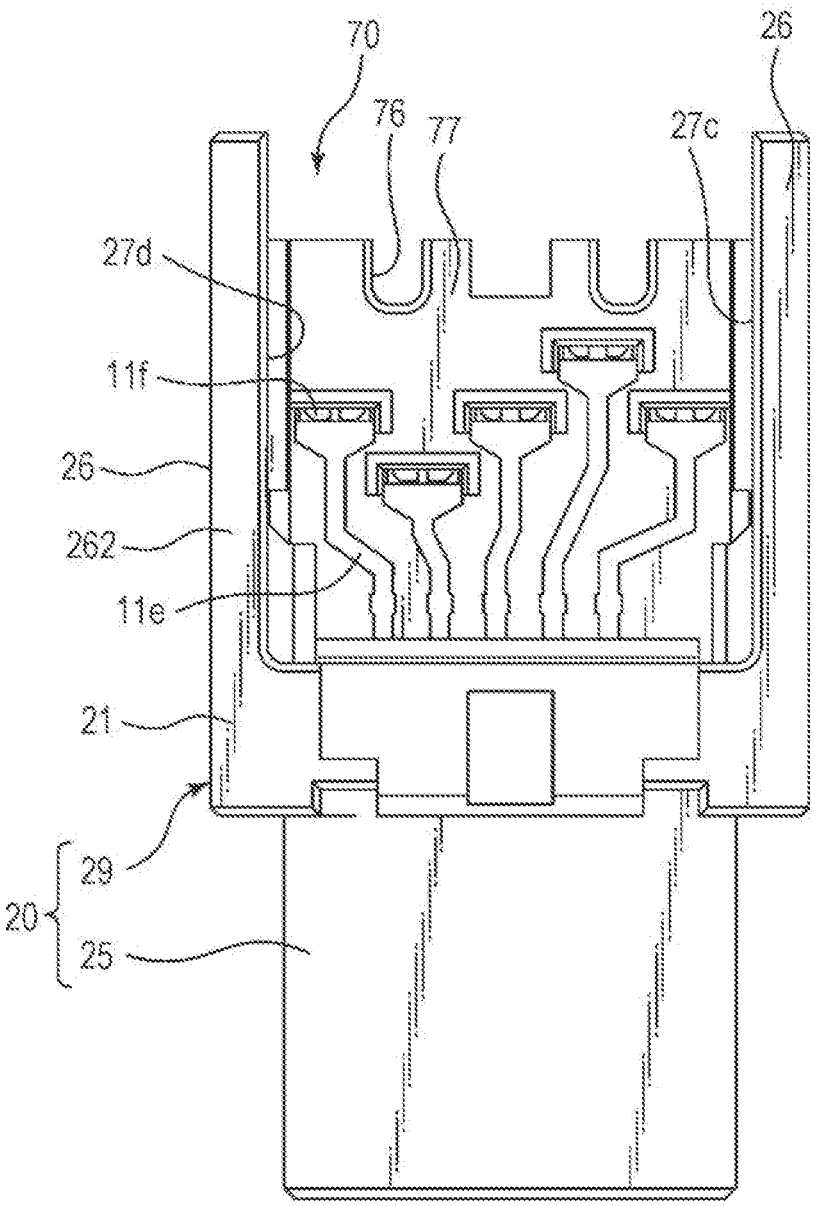
FIG. 4 is a plan view of FIG. 3.
Figure 5:
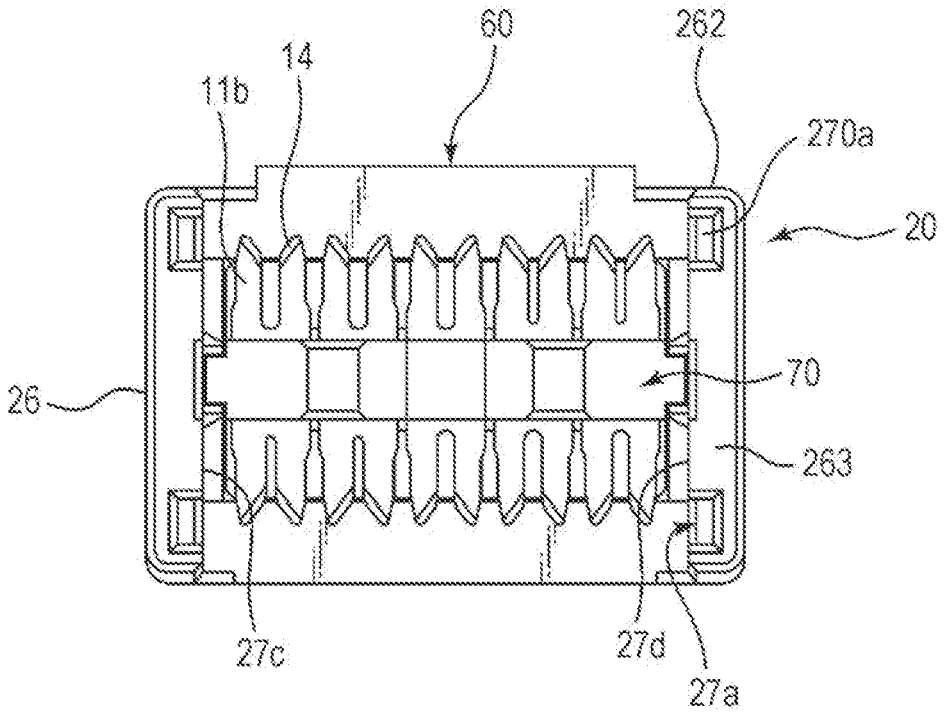
FIG. 5 is a rear view of FIG. 3.

FIG. 1 is a perspective view of the housing 20, a terminal supporter 70, and the cable holders 60, which are components of a cable connector 10 according to one embodiment of the present disclosure as viewed from above. FIG. 2 is a perspective view of them as viewed from below. Two cable holders 60 (60A and 60B) are provided here. In FIGS. 1 and 2, the cable holders 60 are in a state before being mounted on the housing 20. On the other hand, the terminal supporter 70 is already mounted on the housing 20. Furthermore, FIG. 3 is a perspective view illustrating the housing 20 and the terminal supporter 70, which are illustrated in FIGS. 1 and 2, as viewed from a different angle. FIG. 4 is a plan view of FIG. 3. FIG. 5 is a rear view of FIG. 3.

The terminal supporter 70 supports a plurality of terminals 11 in cantilever fashion. The terminals 11 may be integrated with the terminal supporter 70 by integral molding. Alternatively, the terminals 11 may be integrated with the terminal supporter 70, using press-fitting or the like. In this example, the terminals 11 and the terminal supporter 70 are integrally molded. Parts of the terminal 11, for example, a front part of the terminal 11, that is, the vicinity of a tip 11*f* of the terminal 11 extending toward a base portion 21 of the housing 20, and a rear part of the terminal 11, that is, a cable pressure-welding portion 11*b* where a twisted pair cable 5 (refer to, for example, FIG. 13 described below) is pressure-welded, and further, for example, a wiring portion 11*e* that connects the tip 11*f* and the cable pressure-welding portion 11*b*, are still exposed after integral molding.

The terminal supporter 70 includes a plate-shaped main body 77. A top surface 77*a* of the main body 77 is provided with a vertically arranged portion 75. Moreover, left and right side surfaces of the main body 77 are each provided with a lock protruding portion 71*a* protruding outward. Furthermore, a rear edge of the main body 77 is provided with notches 76 of a U-shape in plan view cut out inward. The lock protruding portion 71*a* is fitted along a direction "α" into a lock hole 26*d* provided in a plate-shaped side wall 26 of the housing 20. Consequently, the terminal supporter 70 can be locked to the housing 20. The mounting state of the terminal supporter 70 on the housing 20 can also be checked through a window 26*e* provided in the plate-shaped side wall 26.

A gap that allows a connection to a counterpart terminal when a contacted object, for example, a mating protruding portion provided to a mating hole 97 of a board connector 90 (refer to FIG. 21) is inserted can be formed between contacts 11*d* provided to the tips 1 if of the terminals 11 supported by the terminal supporter 70. The gap is formed along a direction "γ". The tip 11*f* side of the terminal 11 can deform elastically along the direction "γ".

The vertically arranged portion 75 rises from the top surface 77*a* of the terminal supporter 70 along the direction "γ". The terminal 11 is fixed to the terminal supporter 70 at the vertically arranged portion 75.

The cable pressure-welding portion 11*b* extends in the same direction "y" as the vertically arranged portion 75 from the top surface 77*a* of the main body 77 of the terminal supporter 70. Five cable pressure-welding portions 11*b* are placed in such a manner as to be spaced a predetermined distance apart in a direction "β" and located in a staggered manner in the direction "α". A distal end portion 14 of the cable pressure-welding portion 11*b* is bifurcated to form a groove. The twisted pair cable 5 held by the cable holder 60 is pressed into the groove. An outer sheath of the twisted pair cable 5 pressed into the groove is cut here. As a result, an internal core is caught in the groove. In this manner, electrical continuity can be established between the cable 5 and the terminal 11.

Figure 6:
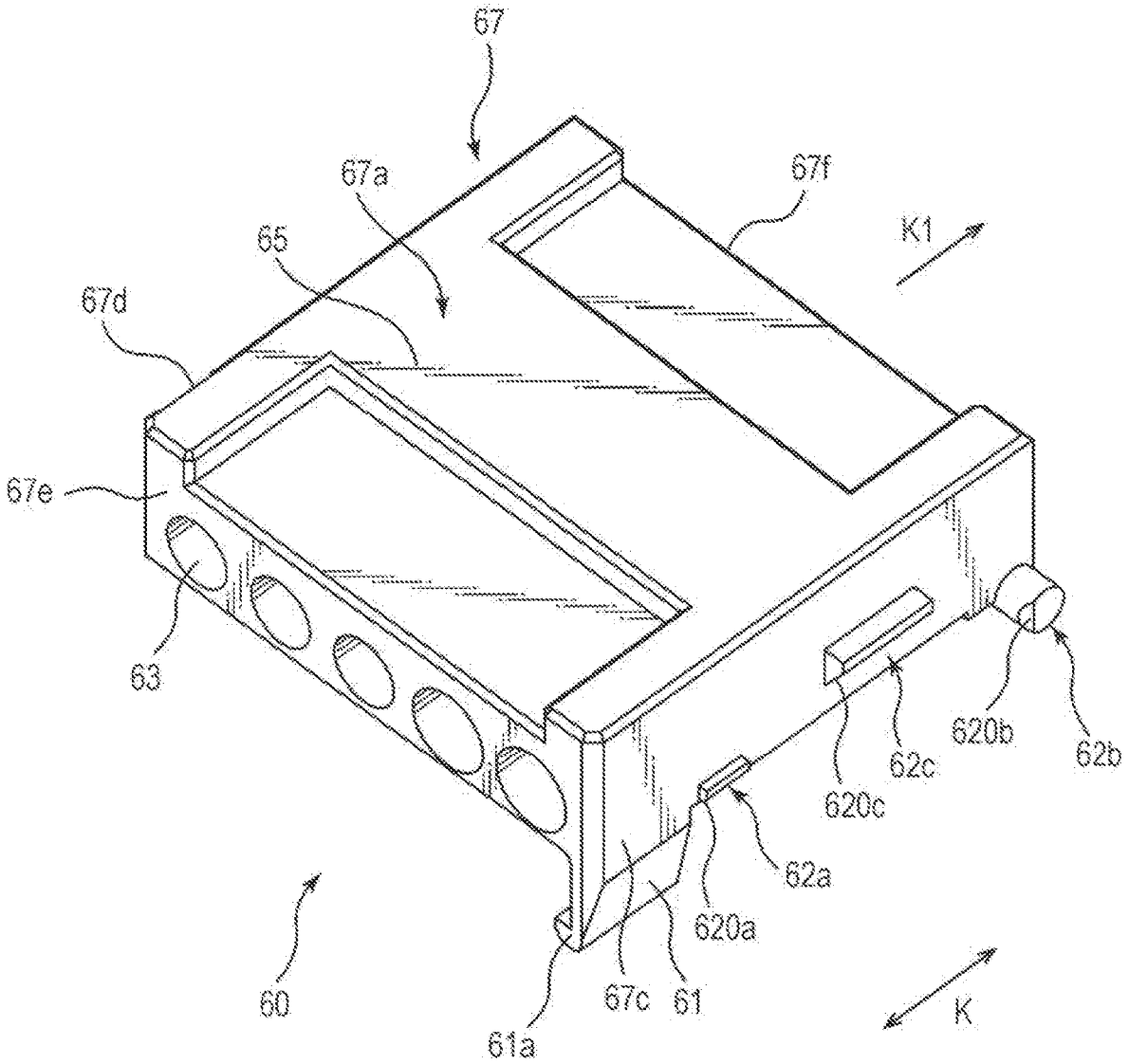
FIG. 6 is a perspective view of the cable holder as viewed from above.
Figure 7:
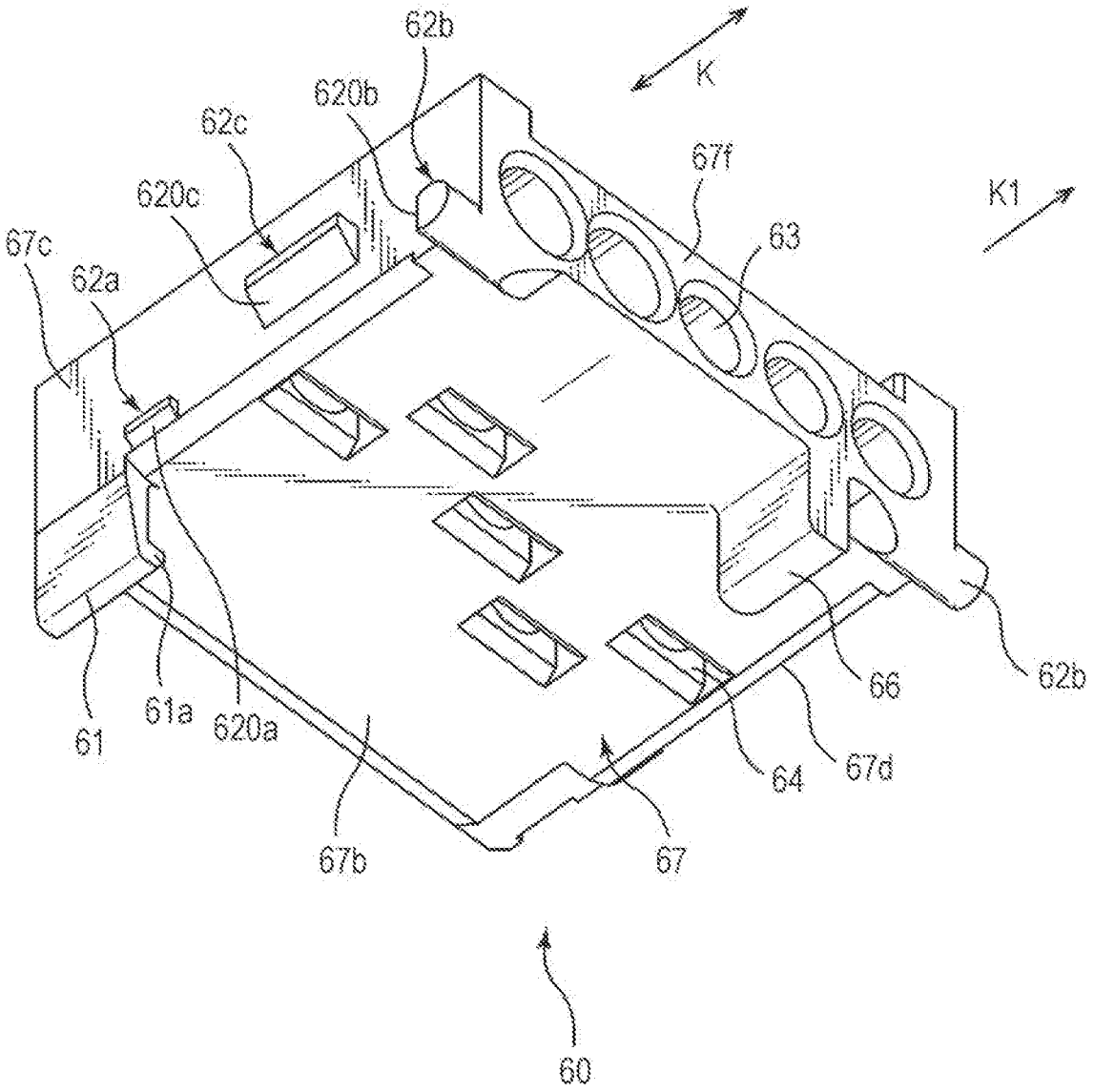
FIG. 7 is a perspective view of the cable holder as viewed from below.
Figure 8:
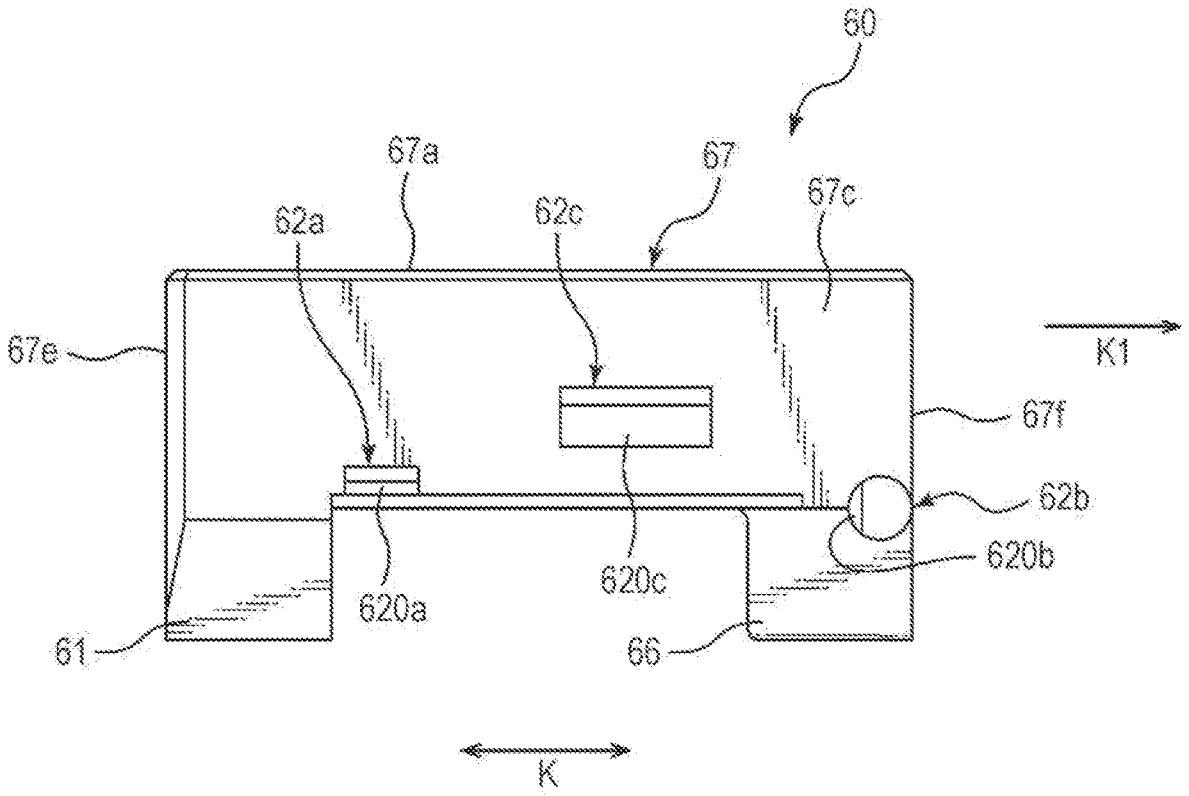
FIG. 8 is a side view of the cable holder.

FIG. 6 is a perspective view of the cable holder 60 illustrated in FIGS. 1 and 2, as viewed from above. FIG. 7 is a perspective view of the cable holder 60 as viewed from below. FIG. 8 is a side view of the cable holder 60.

The cable holders 60 may be formed as the pair of 60A and 60B of the same size and shape as illustrated in the embodiment. The pair has the same size and shape, which facilitates parts management. Moreover, the manufacturing process is also simplified. However, it is not necessarily required to make the size and shape same. The pair may be different in size and shape. Moreover, if a desired effect can be obtained, the pair does not need to have completely the same size or shape. It is sufficient if both of them have substantially the same size and shape. In the following description, only when it is necessary to distinguish between the cable holders 60A and 60B, the letters "A" and "B" are assigned to distinguish them.

The cable holder 60 mainly includes a substantially cuboid main body 67, and an arm portion 61 and a protruding portion 66, which extend downward in cantilever fashion from an undersurface 67*b* of the main body 67.

The arm portion 61 extends along a side surface 67*c* on a front surface 67*e* side of the main body 67. The arm portion 61 can deform elastically in the thickness direction "β". A latch protruding portion 61*a* is provided near a free end of the arm portion 61 extending in cantilever fashion. The latch protruding portion 61*a* can be latched to a latch protruding portion 75*a* (refer to FIG. 1) provided to a part of the terminal supporter 70.

The protruding portion 66 extends on a rear surface 67*f* side of the main body 67. The protruding portion 66 is fitted into the notch 76 provided in the terminal supporter 70. Consequently, the cable holder 60 is mounted on the housing 20. The protruding portion 66 is vertically arranged on the undersurface 67*b* of the main body 67 in the same direction as the arm portion 61.

The main body 67 is provided with a plurality of through-holes 63 reaching the front surface 67*e* and the rear surface 67*f* in a direction "K" along a lead-out direction "K1" of the cable 5 (refer to, for example, FIG. 13 described below). The cable holder 60 uses the through-hole 63 to hold one end side of the twisted pair cable 5. The held one end side of the twisted pair cable 5 is led out in the direction "K1" from the rear surface 67*f* of the main body 67, that is, the cable 5 lead-out side to the outside of the main body 67. On the other hand, an end portion on the one end side of the twisted pair cable held by the cable holder 60 reaches to the vicinity of the front surface 67*e* of the main body 67 on the side (67*e*) opposite to the cable 5 lead-out side (67*f*).

Insertion holes 64 are provided in the undersurface 67*b* of the main body 67. The cable pressure-welding portion 11*b* of the terminal supporter 70 is inserted into the insertion hole 64. The insertion hole 64 communicates with the through-hole 63 through which the twisted pair cable 5 is inserted. Consequently, the sheath of the twisted pair cable 5 inserted through the through-hole 63 can be cut by the cable pressure-welding portion 11*b* inserted through the insertion hole 64 when the cable holder 60 is mounted on the housing 20.

Each of opposing outer side surfaces 67*c* and 67*d* of the main body 67 is provided with at least three engagement portions 62*a* to 62*c*. The three engagement portions 62*a* to 62*c* are formed on each of the outer side surfaces 67*c* and 67*d* of the cable holder 60 as, for example, protruding portions protruding outward. The engagement portion 62*a* is placed on the side (67*e*) far from the cable 5 lead-out side (67*f*) of the cable holder 60 in the direction "K" along the lead-out direction "K1". The engagement portion 62*b* is placed on the side near the lead-out side (67*f*). The engagement portion 62*c* is placed between the engagement portions 62*a* and 62*b*.

The main purpose of the engagement portion 62*a* is to temporarily fasten the cable holder 60 to the housing 20. The engagement portion 62*a* is relatively short in the direction "K" along the lead-out direction "K1", and protrudes relatively small and outward from each of the outer side surfaces 67*c* and 67*d*. Moreover, the engagement portion 62*a* has a substantially trapezoidal shape in cross section crossing the direction "K". The engagement portion 62*a* has, for example, a tapered taper portion 620*a* on the side of mounting on the housing 20.

The main purpose of the engagement portion 62*c* is to fix the cable holder 60 to the housing 20. The engagement portion 62*c* is relatively long in the direction "K" along the lead-out direction "K1", and protrudes relatively long and outward from each of the outer side surfaces 67*c* and 67*d*. The engagement portion 62*c* also has a substantially trapezoidal shape in cross section crossing the direction "K" as in the engagement portion 62*a*. The engagement portion 62*c* has, for example, a tapered taper portion 620*c* on a side of mounting on the housing 20.

The main purpose of the engagement portion 62*b* is to, when the cable holder 60 is mounted on the housing 20, hold the cable holder 60 in such a manner as to be rotatable with respect to the housing 20 and prevent the cable holder 60 from being displaced in, for example, the direction "K" with respect to the housing 20. The engagement portion 62*b* has a substantially cylindrical shape protruding from each of the outer side surfaces 67*c* and 67*d*, unlike the engagement portions 62*a* and 62*c*. The cable holder 60 is mounted in such a manner as to be rotatable with respect to the housing 20, using a curved surface of the substantial cylinder into which the engagement portion 62*b* has been formed. A part of an end portion of a top surface of the substantial cylinder of the engagement portion 62*b* is cut diagonally to form a taper 620*b*.

FIGS. 1 to 5 are referred to again. Three corresponding engagement portions 26*a* to 26*c* are provided on each of opposing inner side surfaces 27*c* and 27*d* of the plate-shaped side walls 26 of the housing 20, corresponding to the three engagement portions 62*a* to 62*c* provided to the cable holder 60. Each of these three corresponding engagement portions 26*a* to 26*c* is formed as a recessed portion recessed inward, particularly as a latch hole in the embodiment, in each of the inner side surfaces 27*c* and 27*d* of the housing 20. When the cable holder 60 is mounted on the housing 20, the engagement portions 62*a* to 62*c* provided to the cable holder 60 engage with the corresponding engagement portions 26*a* to 26*c* provided to the housing 20, respectively. In this manner, it is possible to configure a combination of the recessed portion and the protruding portion.

FIGS. 9 to 13 are side views illustrating the attitude and position of the cable holder 60 in stages when the cable holder 60 is mounted on the housing 20. The cable holder 60 moves sequentially through the states of FIGS. 9 and 10 to the states of FIGS. 11 and 12, and reaches the state of FIG. 13 in the end.

When the cable holder 60 is mounted on the housing 20, the engagement portions 62*a* to 62*c* provided to the cable holder 60 engage with the corresponding engagement portions 26*a* to 26*c* provided to the housing 20, respectively. At this point in time, these engagement portions 62*a* to 62*c* and corresponding engagement portions 26*a* to 26*c* allow the cable holder 60 to take at least two engagement positions with respect to the housing 20, that is, a "first engagement position" illustrated in FIGS. 11 and 12 and a "second engagement position" illustrated in FIG. 13.

Figure 11:
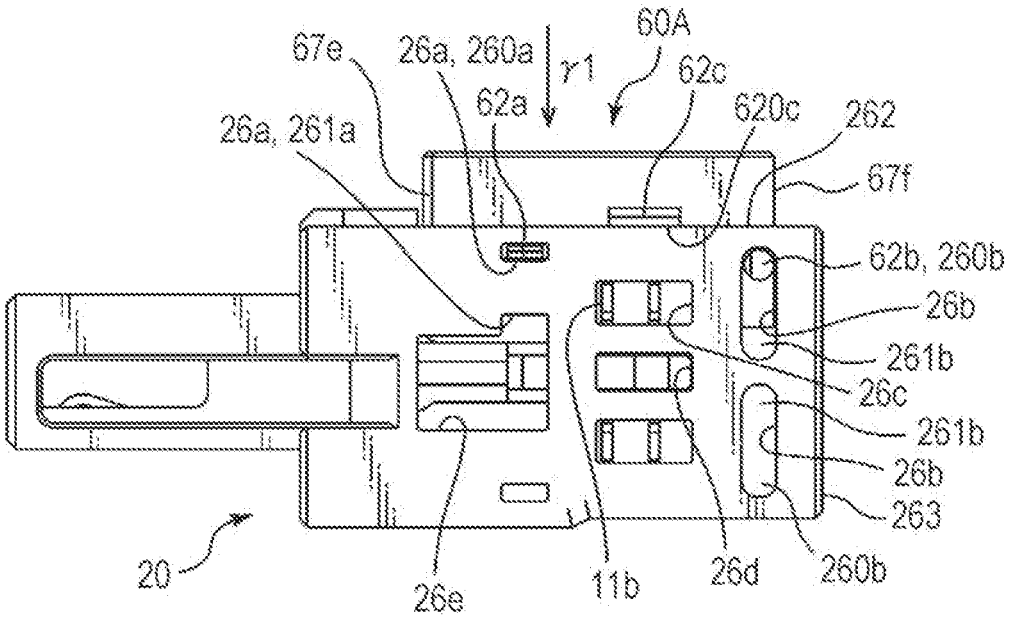
FIG. 11 is one of side views illustrating the attitude and position of the cable holder in stages when the cable holder is mounted on the housing, and illustrates the first engagement position.
Figure 12:
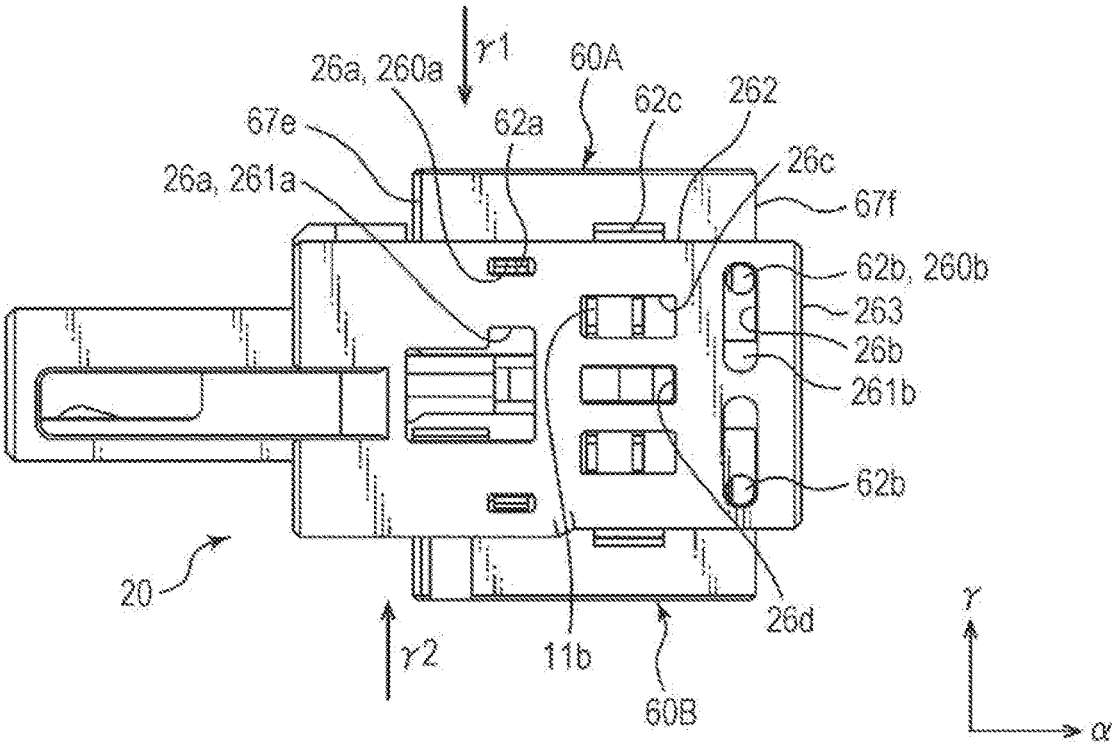
FIG. 12 is one of side views illustrating the attitude and position of the cable holder in stages when the cable holder is mounted on the housing, and illustrates the first engagement position.

At the first engagement position illustrated in FIGS. 11 and 12, the engagement portions 62*a* and 62*b* are in engagement with the corresponding engagement portions 26*a* and 26*b*, respectively. However, the engagement portion 62*c* has not yet engaged with the corresponding engagement portion 26*c*.

Figure 13:
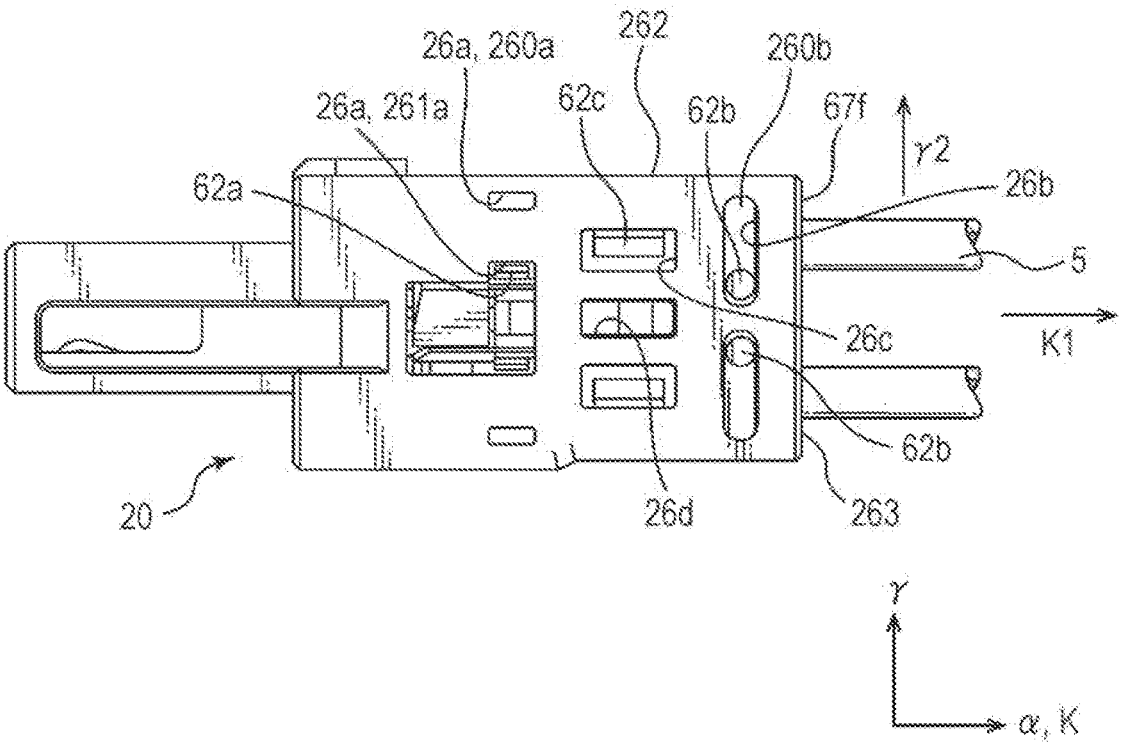
FIG. 13 is one of side views illustrating the attitude and position of the cable holder in stages when the cable holder is mounted on the housing, and illustrates the second engagement position.

On the other hand, at the second engagement position illustrated in FIG. 13, all the engagement portions 62*a*, 62*b*, and 62*c* are in engagement with the corresponding engagement portions 26*a*, 26*b*, and 26*c*, respectively.

In other words, the first engagement position is a position for temporarily fastening the cable holder 60 to the housing 20 (corresponding to the "temporary fixing position" in WO 18/016389 A). On the other hand, the second engagement position is a position for fixing (completely fastening) the cable holder 60 to the housing 20 (corresponding to the "latching completed position" in WO 18/016389 A mentioned above). When the cable holder 60 is mounted on the housing 20, the cable holder 60 is pressed against the housing 20 along an engagement direction "γ1" or "γ2" from the first engagement position to the second engagement position. Consequently, it is possible to cause the engagement portions 62*a* to 62*c* to engage with the corresponding engagement portions 26*a* to 26*c*, respectively.

In terms of the first and second engagement positions, the corresponding engagement portion 26*a* further includes a temporary fastening portion 260*a* and a fixing portion 261*a*. When the cable holder 60 is located at the first engagement position with respect to the housing 20, the temporary fastening portion 260*a* temporarily fastens the engagement portion 62*a*. When the cable holder 60 is located at the second engagement position with respect to the housing 20, the fixing portion 261*a* fixes the engagement portion 62*a* at the position. These temporary fastening portion 260*a* and fixing portion 261*a* are spaced apart from each other in the direction "y" along the engagement directions "γ1" and "γ2" (refer to FIGS. 12 and 14). As illustrated in the embodiment, the fixing portion 261*a* may be a part of the window 26*e*.

Moreover, in terms of the first and second engagement positions, the corresponding engagement portion 26*c* functions as a fixing portion that fixes the engagement portion 62*c* when the cable holder 60 is located at the second engagement position with respect to the housing 20. On the other hand, an upper edge portion 262 of the housing 20 extending in a direction crossing the direction "y" along the engagement directions "γ1" and "γ2" functions as the corresponding engagement portion 26*c* when the cable holder 60 is located at the first engagement position with respect to the housing 20.

Furthermore, in terms of the first and second engagement positions, the corresponding engagement portion 26*b* is formed in such a manner as to be capable of engaging with the engagement portion 62*b* between the position of engaging with the engagement portion 62*b* at the time when the cable holder 60 is located at the first engagement position with respect to the housing 20 and the position of engaging with the engagement portion 62*b* at the time when the cable holder 60 is located at the second engagement position. The corresponding engagement portion 26*b* is formed here as a slide portion extending continuously along the engagement directions "γ1" and "γ2" in such a manner as to, for example, be capable of engaging with the engagement portion 62*b* in a sliding manner.

A recessed guide groove 27*a* is provided in each of the inner side surfaces 27*c* and 27*d* of the plate-shaped side walls 26 of the housing 20. The recessed guide groove 27*a* functions as a guide portion that guides the engagement portion 62*b* to the corresponding engagement portion 26*b* when the cable holder 60 is mounted on the housing 20 (refer to FIGS. 1 and 3). The recessed guide groove 27*a* extends along the direction "α" crossing the direction "y" along the engagement directions "γ1" and "γ2" from the first engagement position to the second engagement position. The recessed guide groove 27*a* reaches the corresponding engagement portion 26*b* from an edge 263 formed on the rear surface 67*f* of the housing 20 via a protruding portion 271*a* protruding further inward of each of the inner side surfaces 27*c* and 27*d*. In this manner, the recessed guide groove 27*a* is provided not along the direction "y" along the engagement direction but along the direction "a" crossing the direction "y". Consequently, the recessed guide portion can be provided without reducing the strength of the plate-shaped side wall 26 of the housing 20. The recessed guide groove 27*a* is further provided with a taper 270*a* corresponding to the taper 620*b* (refer to FIG. 6) provided to the engagement portion 62*b* of the cable holder 60. A path for the taper 620*b* along the taper 270*a* is increasingly narrowed toward the corresponding engagement portion 26*b* in the relationship with the taper 620*b*. The taper 270*a* reaches the protruding portion 271*a* in the end. Such a taper 270*a* is provided; accordingly, the engagement portion 62*b* can be guided more smoothly to the corresponding engagement portion 26*b*.

Figure 9:
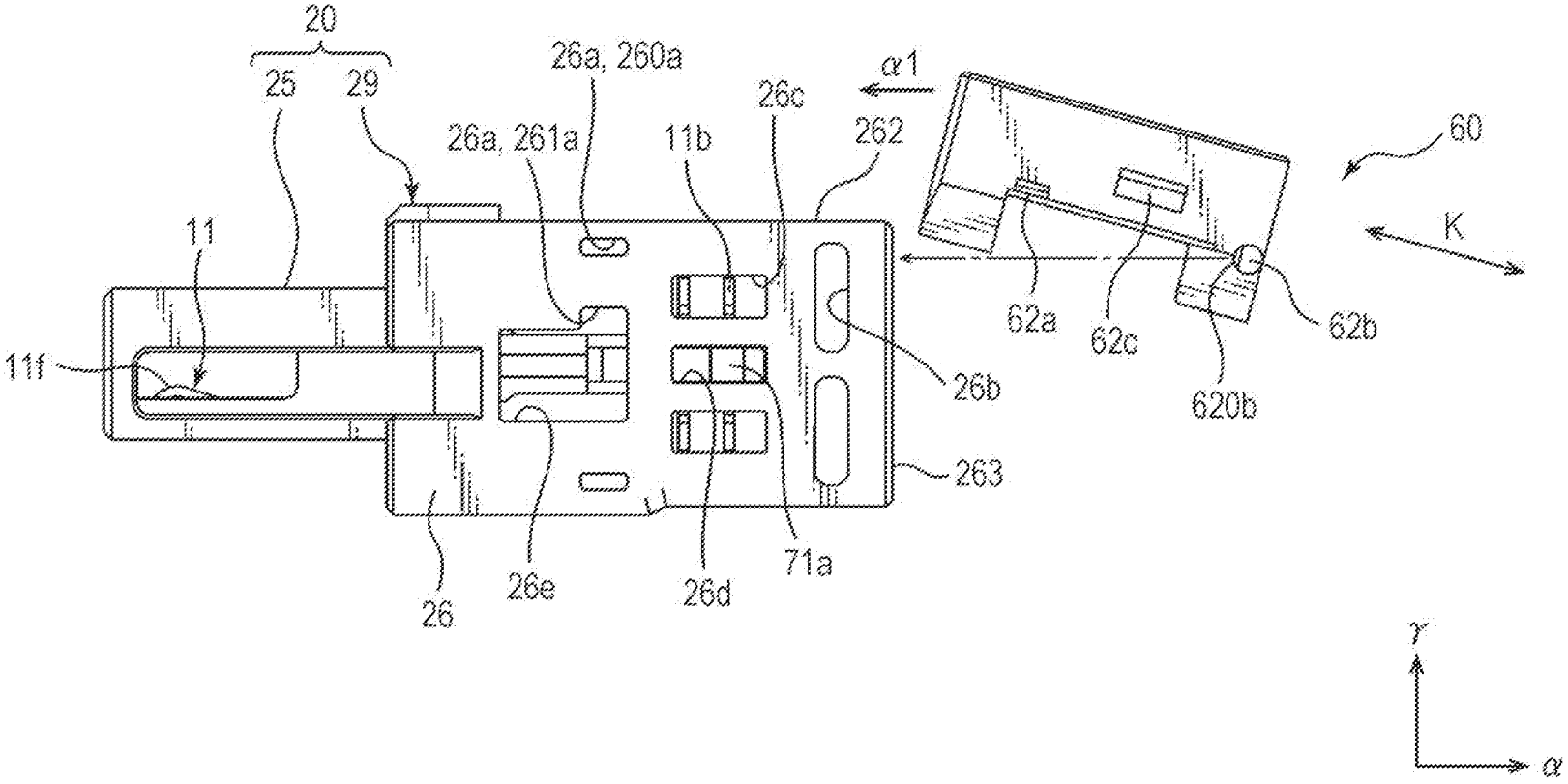
FIG. 9 is one of side views illustrating the attitude and position of the cable holder in stages when the cable holder is mounted on the housing, and illustrates the position of the cable holder before reaching a first and a second engagement position.

When the cable holder 60 is mounted on the housing 20, the cable holder 60 moves closer to the housing 20 in a direction "α1" as illustrated in FIG. 9. At this point in time, the cable holder 60 moves closer to the housing 20, inclined with respect to the housing 20, more specifically, in such a manner that an angle formed by the direction (K) along the lead-out direction of the cable holder 60 and the direction (γ) along the engagement direction (a smaller angle of the angles formed by "K" and "y") maintains an acute angle. The angle formed by the direction (K) along the lead-out direction of the cable holder 60 and the direction (γ) along the engagement direction may be a substantially right angle, but is not particularly illustrated. As a result, firstly, the engagement portion 62*b* provided to the cable holder 60 is inserted into the recessed guide groove 27*a* (refer to FIGS. 1 and 3) provided to the housing 20, and guided along the recessed guide groove 27*a*. When the engagement portion 62*b* is in such an attitude, the taper 620*b* provided to the engagement portion 62*b* is located on the corresponding engagement portion 26*b* side. The engagement portion 62*b* moves toward the corresponding engagement portion 26*b* along the taper 270*a* provided to the recessed guide groove 27*a*. In order to do so, the taper 270*a* is tapered in such a manner as to increasingly reduce the distance between the opposing inner side surfaces 27*c* and 27*d* of the plate-shaped side walls 26 of the housing 20. As a result, the engagement portion 62*b* is smoothly guided to the recessed guide groove 27*a* in an early stage. The engagement portion 62*b* then moves over the protruding portion 271*a* provided to a part of the recessed guide groove 27*a* in the end, using the elastic action of the plate-shaped side wall 26 forming the taper 270*a*. Consequently, the engagement portion 62*b* is snapped into the corresponding engagement portion 26*b*.

Figure 10:
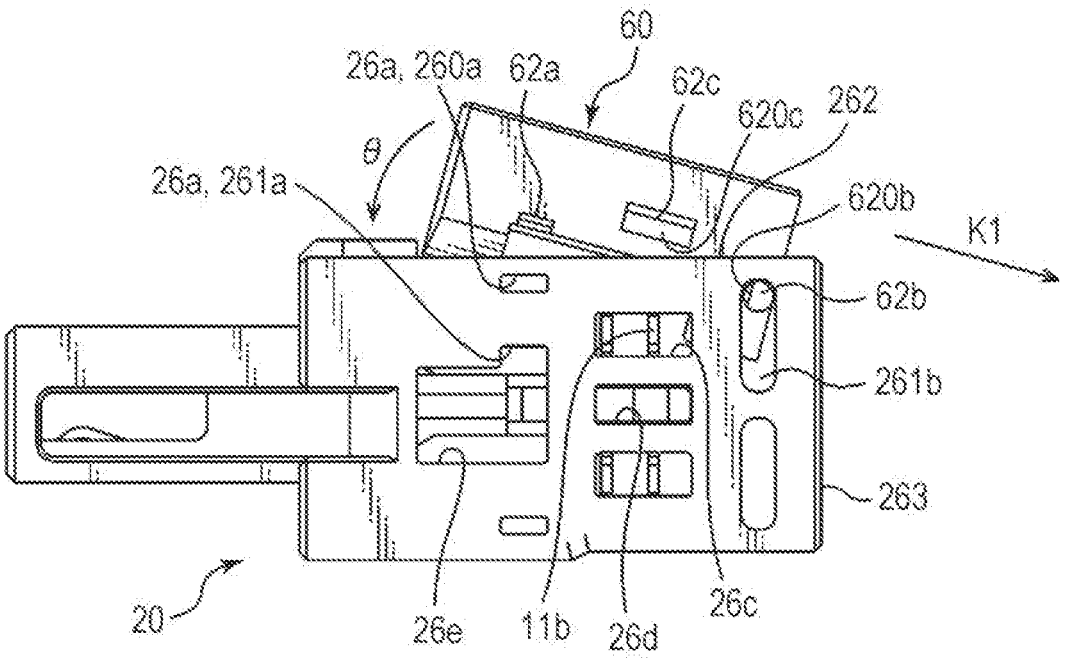
FIG. 10 is one of side views illustrating the attitude and position of the cable holder in stages when the cable holder is mounted on the housing, and illustrates the cable holder before reaching the first and the second engagement position.

FIG. 10 illustrates the engagement portion 62*b* immediately after engaging with the engagement portion 26*b* through the above steps. At this point in time, the engagement portion 62*b* faces the corresponding engagement portion 26*b* on a side opposite to the engagement side, that is, on a side where the taper 620*b* is not provided, in the lead-out direction "K1". Hence, the cable holder 60 does not easily come out of the housing 20.

After set to the state of FIG. 10, the cable holder 60 rotates about the engagement portion 62*b* in a direction "θ" with respect to the housing 20. Consequently, the cable holder 60 takes the first engagement position illustrated in FIG. 11. At this point in time, the engagement portion 62*a* uses the elastic action of the taper portion 620*a* (refer to FIGS. 6 to 8) and the plate-shaped side wall 26 to engage with the temporary fastening portion 260*a*. On the other hand, the engagement portion 62*c* has not yet engaged with the corresponding engagement portion 26*c*. Instead, the tapered taper portion 620*c* of the engagement portion 62*c* is put in a state of engaging with the upper edge portion 262 of the housing 20, that is, a state of being simply mounted thereon. Moreover, at this point in time, the engagement portion 62*c* and the corresponding engagement portion 26*c* are adjusted in such a manner as to be located near the pressure-welding portion 11*b* in the direction "K" along the lead-out direction "K1". FIG. 12 illustrates the cable holder 60B after being mounted on the housing 20 in a method similar to the one illustrated in FIG. 11, that is, the cable holder 60B at the first engagement position. The first engagement position illustrated in FIGS. 11 and 12 corresponds to a factory-shipped state. In spite of the fact that the engagement portion 62*c* and the corresponding engagement portion 26*c* have not yet engaged with each other, the engagement portion 62*c* and the corresponding engagement portion 26*c* stay stable due to the engagement of the engagement portion 62*a* and the temporary fastening portion 260*a* and the engagement of the engagement portions 62*b* and 26*b*.

After set to the states of FIGS. 11 and 12, the cable holder 60 is pressed against the housing 20 in the engagement direction "γ1" or "γ2" from the first engagement position to the second engagement position by use of, for example, a jig. Consequently, the cable holder 60 takes the second engagement position illustrated in FIG. 13. At this point in time, the engagement portion 62*a* engages with the fixing portion 261*a*, using, for example, the elastic action of the plate-shaped side wall 26. Moreover, the engagement portion 62*c* engages with the corresponding engagement portion 26*c*, using, for example, the elastic action of the taper portion 620*c* and the plate-shaped side wall 26. Furthermore, the engagement portion 62*b* slides from a temporary fastening position 260*b* to a fixing position 261*b* in the corresponding engagement portion 26*b*. The sliding directions of the engagement portions 62*b* in the corresponding engagement portions 26*b* are the same as the moving directions of the cable holders 60A and 60B with respect to the housing 20, that is, the engagement directions "γ1" and "γ2" when taking the second engagement position from the first engagement position. This allows the cable holder 60 to move from the first engagement position to the second engagement position while keeping its attitude, by use of the engagement of the engagement portion 62*b* and the corresponding engagement portion 26*b*. Moreover, at this point in time, the engagement portion 62*b* functions as a stopper that prevents the engagement portion 62*b* from moving in the lead-out direction "K1". In addition, the engagement portion

62*b* also functions as a guide that specifies the pressing direction "y" when the cable holder 60 is pressed against the housing 20.

When the cable holder 60 that has been pressed against the housing 20 moves from the first engagement position to the second engagement position, the cable 5 is pressure-welded onto the cable pressure-welding portion 11*b*. As a result, a user receives a large reaction force at a portion where the cable pressure-welding portions 11*b* are located, that is, a portion provided with the engagement portion 62*c* and the corresponding engagement portion 26*c* in the direction "K" along the lead-out direction "K1". Hence, a pressing operation by use of, for example, a jig is performed, preferably near the position provided with the engagement portion 62*c* and the corresponding engagement portion 26*c*. These engagement portion 62*c* and corresponding engagement portion 26*c* are located halfway between the engagement portions 62*a* and 62*b*, and halfway between the corresponding engagement portions 26*a* and 26*b* in the direction "K" along the lead-out direction "K1". Accordingly, also in terms of dispersing the force evenly, the pressing operation is preferably performed near the position provided with the engagement portion 62*c* and the corresponding engagement portion 26*c*. The pressing operation is performed at this position to allow the cable holder 60 to move from the first engagement position illustrated in FIGS. 11 and 12 to the second engagement position illustrated in FIG. 13 with the attitude unchanged, and furthermore without floating the engagement portion 62*a* side and conversely floating the engagement portion 62*b* side. A relatively large force is applied to the engagement portion 62*c*. Hence, the protrusion of the engagement portion 62*c* is set to be greater than that of the engagement portion 62*a*.

When the cable holder 60 is located at the first or second engagement position with respect to the housing 20, the direction "K" along the lead-out direction and the direction "y" along the engagement direction cross each other, at an angle of substantially 90 degrees in the embodiment, as illustrated in FIGS. 11 to 13. In this case, in the state illustrated in FIG. 13, a force may be accidentally applied, for example, in the direction "γ2" along the engagement direction to the cable 5 held by the cable holder 60, particularly to the cable 5 lead-out side (refer to 67*f* in, for example, FIGS. 11 and 12). A large force is then applied to the engaged portion of the engagement portion 62*c* and the corresponding engagement portion 26*c*. However, the positions where the engagement portions 62*a* to 62*c* provided to the cable holder 60 engage with the corresponding engagement portions 26*a* to 26*c* provided to the housing 20, respectively, are spaced apart from each other in the direction "K" along the lead-out direction "K1". Accordingly, even if such a force is applied, engagement means on the side (refer to 67*e* in, for example, FIGS. 11 and 12) opposite to the lead-out side, particularly the engagement of the engagement portion 62*a* and the corresponding engagement portion 26*a*, can effectively prevent the cable holder 60 from coming out of the housing 20.

Finally, the state of the cable holder 60 at the first engagement position with respect to the housing 20 is described in more detail with reference to FIGS. 14 to 20.

Figure 14:
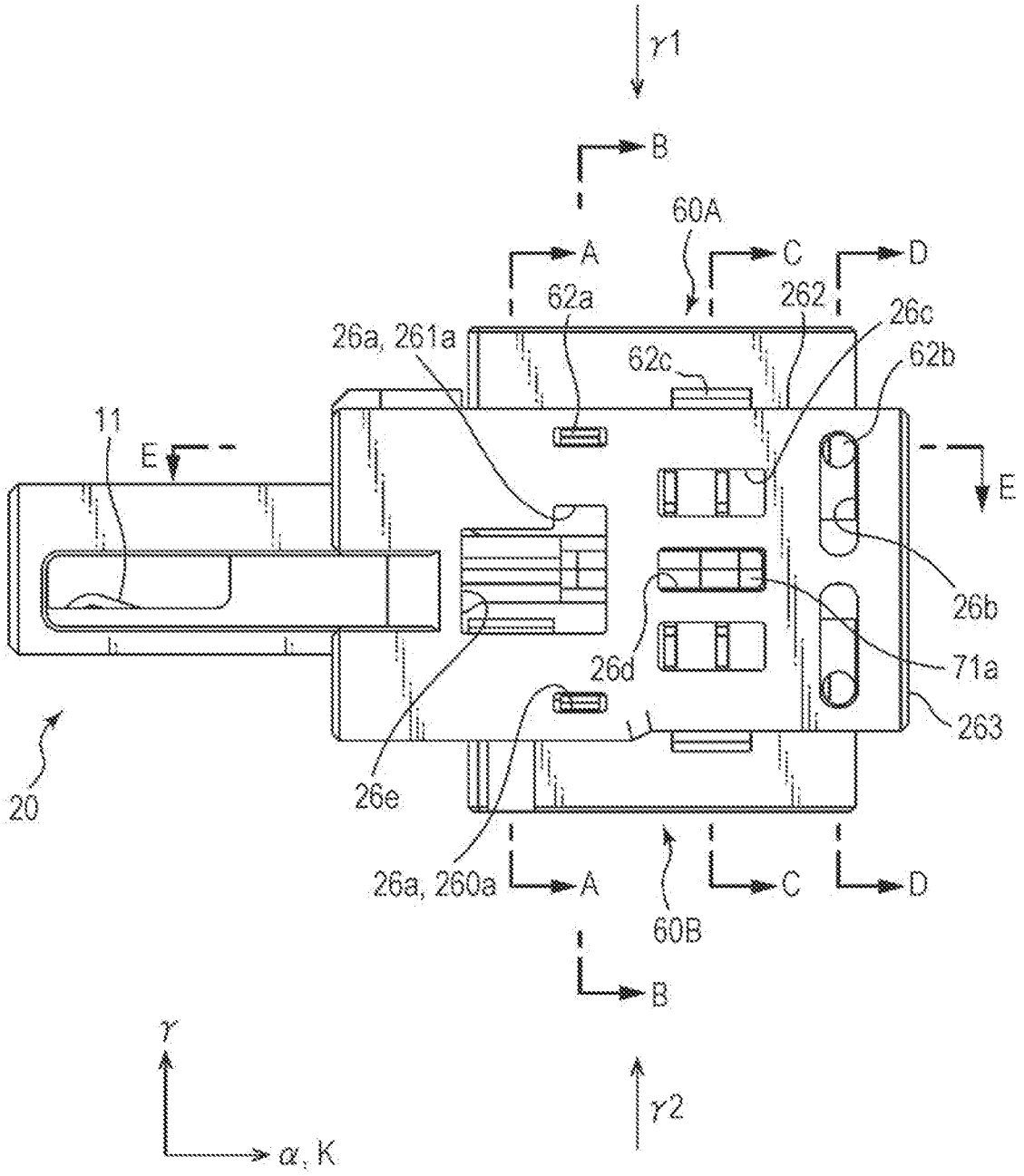
FIG. 14 is a side view corresponding to FIG. 12.
Figure 15:
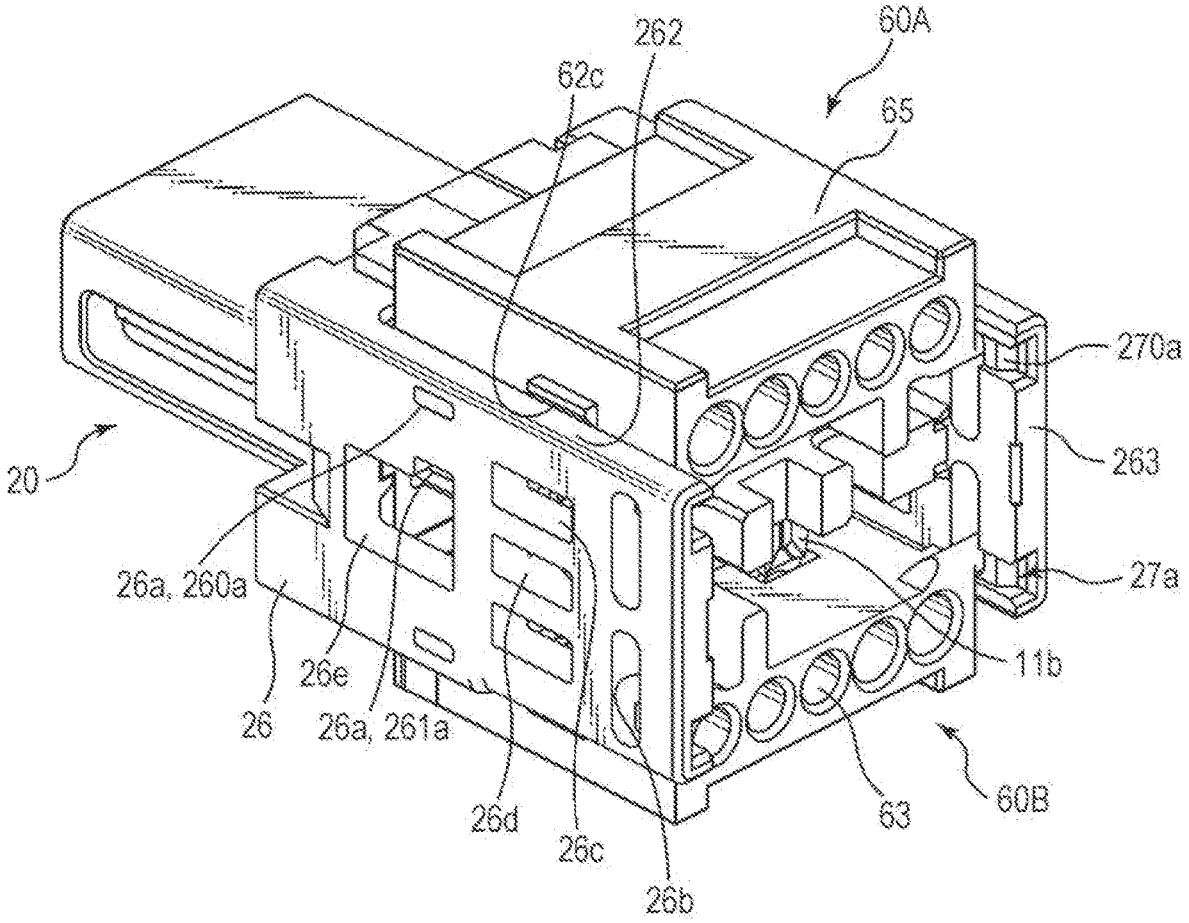
FIG. 15 is a perspective view of, for example, the cable holder and the housing, which are illustrated in FIG. 12, as viewed from the rear.

FIG. 14 is a side view corresponding to FIG. 12. FIG. 15 is a perspective view of, for example, the cable holder 60 and the housing 20, which are illustrated in FIG. 12, as viewed from the rear.

Figure 16:
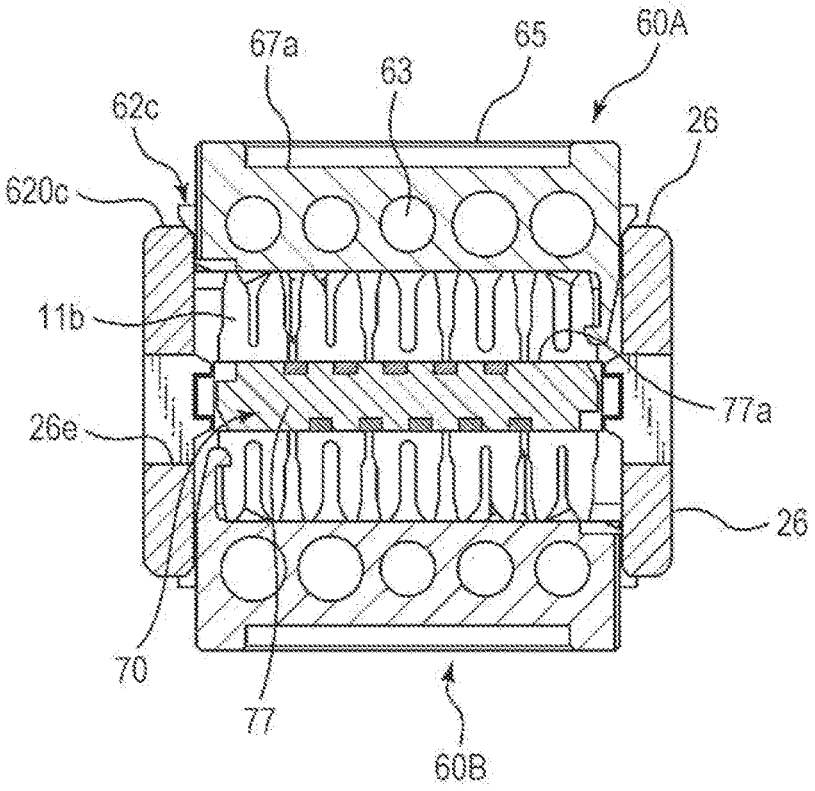
FIG. 16 is a cross-sectional view taken along line A-A in FIG. 14.
Figure 17:
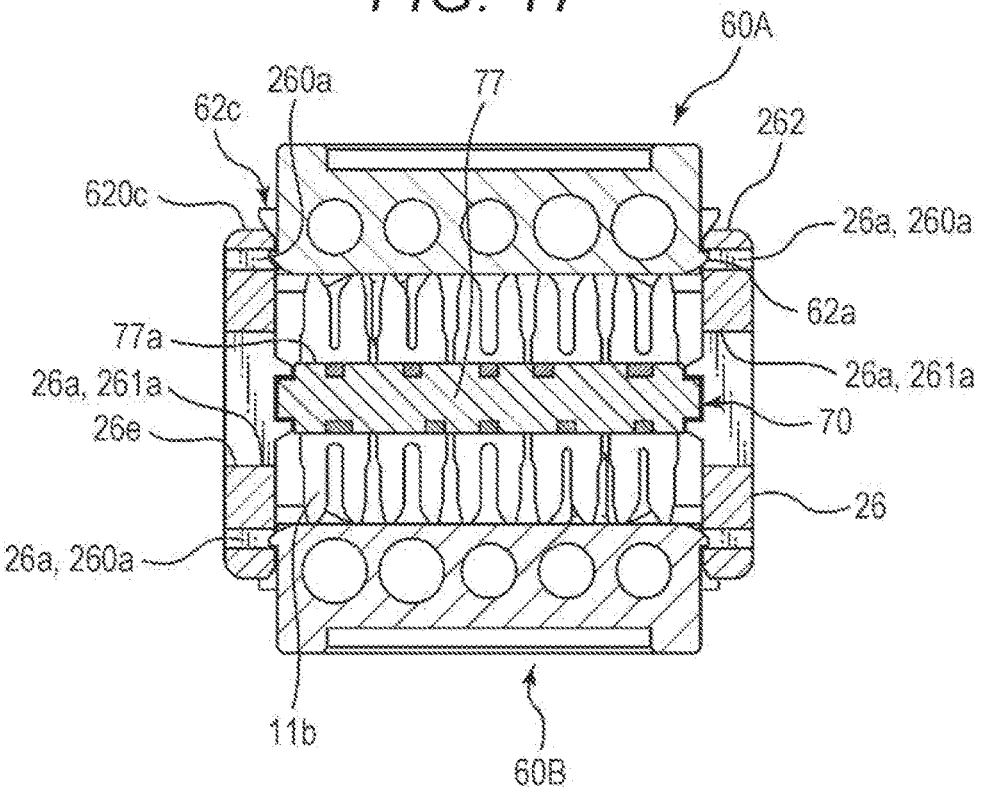
FIG. 17 is a cross-sectional view taken along line B-B in FIG. 14.
Figure 18:
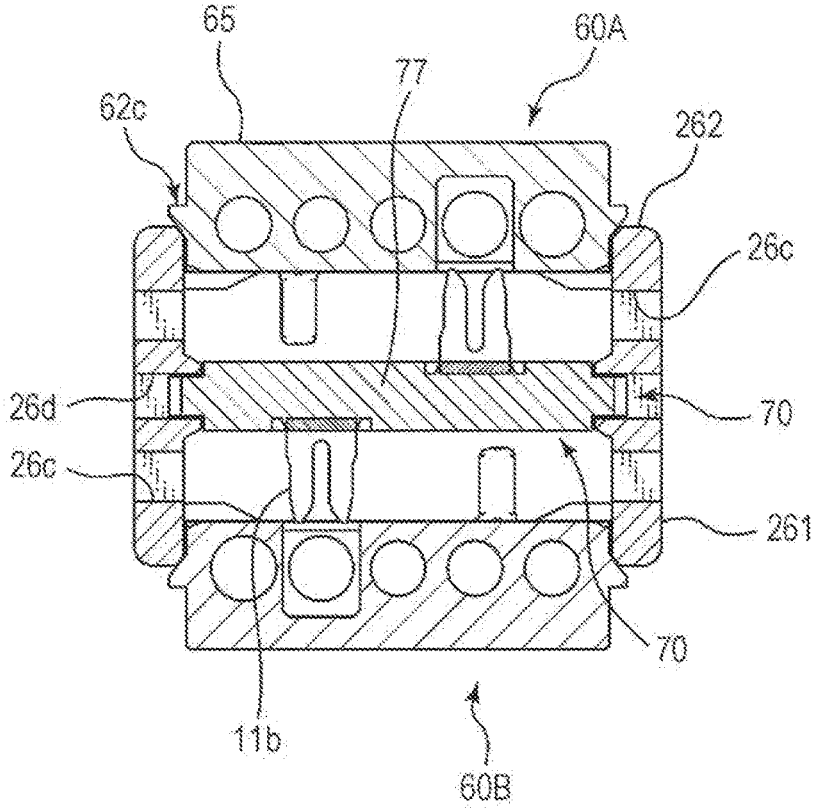
FIG. 18 is a cross-sectional view taken along line C-C in FIG. 14.
Figure 19:
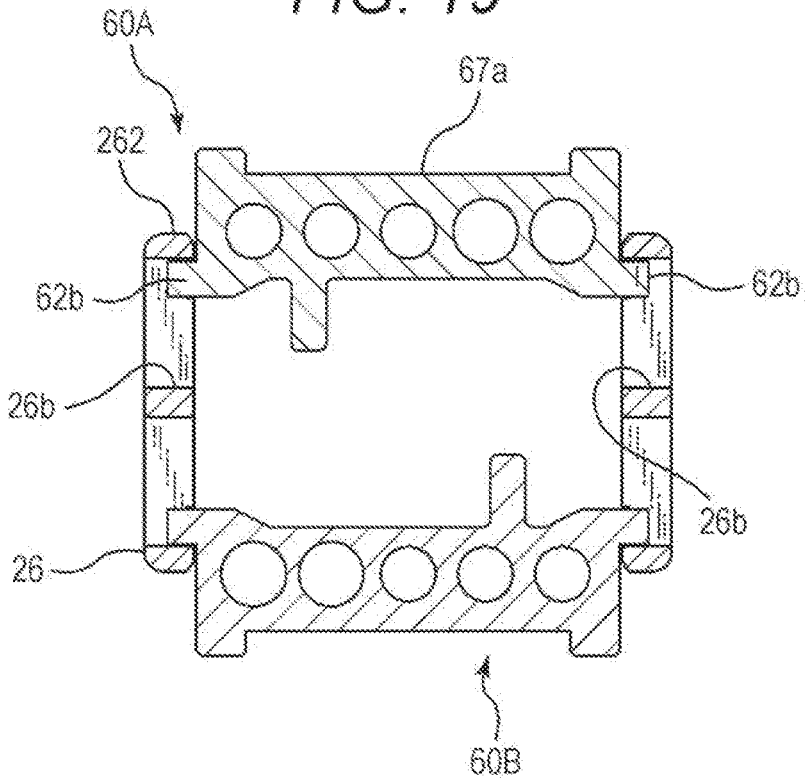
FIG. 19 is a cross-sectional view taken along line D-D in FIG. 14.
Figure 20:
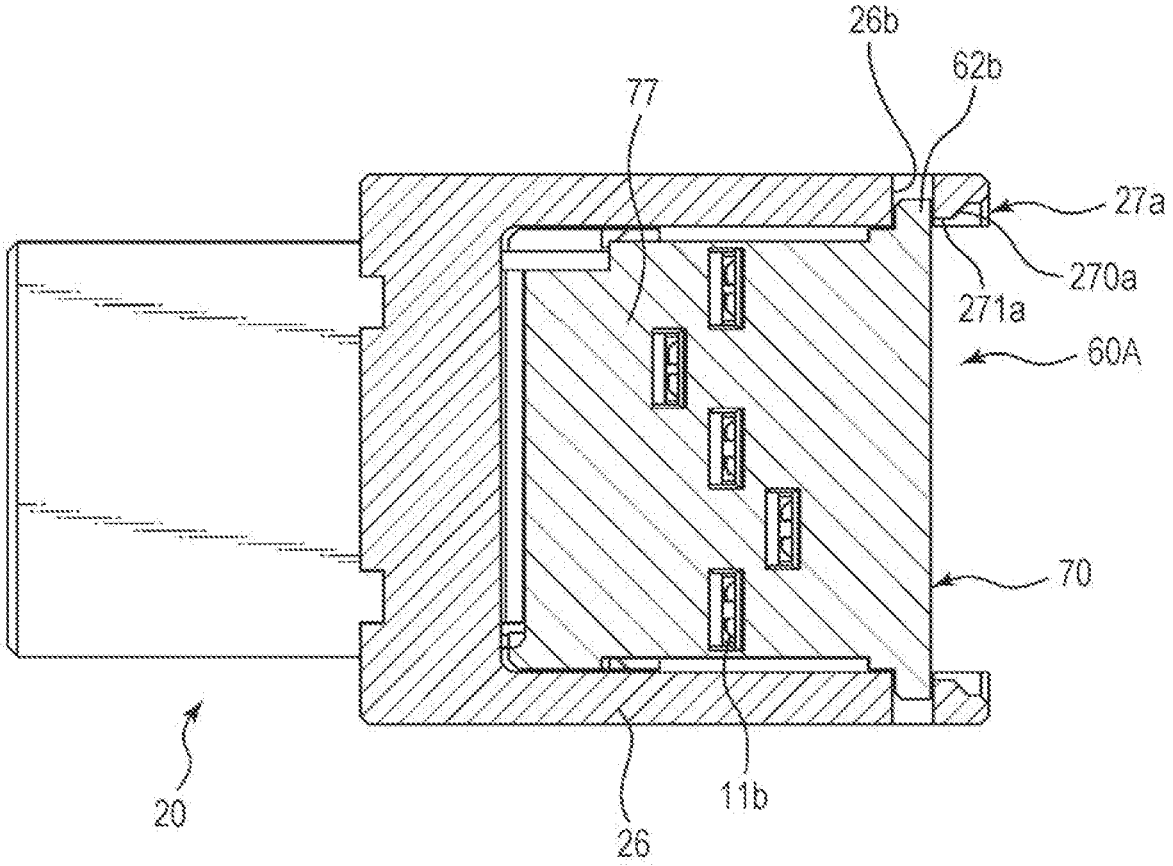
FIG. 20 is a cross-sectional view taken along line E-E in FIG. 14.

Moreover, FIGS. 16 to 19 are cross-sectional views taken along lines A-A to E-E in FIG. 14. FIG. 16 particularly illustrates an engaged state of the engagement portion 62*c* of the cable holder 60 and the upper edge portion 262 of the housing 20. FIG. 17 particularly illustrates an engaged state of the engagement portion 62*a* of the cable holder 60 and the corresponding engagement portion 26*a* (the temporary fastening portion 260*a*) of the housing 20. FIG. 18 particularly illustrates a relationship between the engagement portion 62*c* of the cable holder 60 and the corresponding engagement portion (fixing portion) 26*c* of the housing 20. FIG. 19 particularly illustrates an engaged state of the engagement portion 62*b* of the cable holder 60 and the corresponding engagement portion (slide portion) 26*b* of the housing 20.

The state illustrated in FIGS. 14 to 20 corresponds to, for example, the factory-shipped state. At this point in time, the cables 5 have not yet been mounted. On the other hand, the cable holder 60 has already been placed at the first engagement position with respect to the housing 20. As already described, the cable holder 60 placed previously is stably held by the engagement of the engagement portion 62*a* and the temporary fastening portion 260*a* and the engagement of the engagement portions 62*b* and 26*b*. Therefore, going out of engagement at the first engagement position due to, for example, vibrations occurring during the delivery of the product is prevented.

Moreover, also during an operation of connecting the cable holder 60 after the product is delivered to a worksite such as a factory, the cable holder 60 placed previously is stably held. During the connection operation, especially when one end side of the cable 5 (refer to, for example, FIG. 12) has already been held by the cable holder 60 at the first engagement position, a user may accidentally touch the cable, and apply a force to the cable holder 60 via the cable. More specifically, a user may apply a force to each of the cable holders 60A and 60B in a direction opposite to the direction of being pressed against the housing 20 in the direction "γ1" or "γ2", that is, in a direction pulling the cable holder 60 away from the housing 20. Also in this case, according to the embodiment, the engagement portion 62*a* and the corresponding engagement portion 26*a*, which are located on the side opposite in the direction "K" along the lead-out direction "K1" to the side where the cable is held, engage with each other, which allows the first engagement position taken previously can be reliably maintained.

After the connection operation, a pressing portion 65 (clearly illustrated in, for example, FIGS. 1 and 15) provided on the top surface 67*a* of the cable holder 60 is simply pressed, using, for example, a jig to enable the cable holder 60 to move to the second engagement position illustrated in FIG. 13.

In this case, as illustrated in the embodiment, it is preferable that the engagement portion 62*c* be located in such a manner as to be placed at a position corresponding to the cable pressure-welding portion 11*b* in the direction "K(α)" along the lead-out direction "K1" and furthermore that the pressing portion 65 be provided near the engagement portion 62*c*. Such a configuration allows conveying the force applied to the pressing portion 65 more efficiently to the cable 5 placed in the upper part of the cable pressure-welding portion 11*b*.

The embodiment is not limited to the above-mentioned embodiment. The above-mentioned embodiment can be modified in various manners.

For example, in the embodiment described above, the engagement portions 62*a* to 62*c* provided to the outer side surfaces 67*c* and 67*d* of the cable holder 60 are, for example, protruding portions that protrude outward from each of the outer side surfaces 67*c* and 67*d* while the corresponding engagement portions 26*a* to 26*c* provided to the inner side surfaces 27*c* and 27*d* of the housing 20 are, for example, recessed portions that are recessed inward in each of the inner side surfaces 27*c* and 27*d*. However, conversely, the engagement portions 62*a* to 62*c* provided to the outer side surfaces 67*c* and 67*d* of the cable holder 60 may be, for example, recessed portions that are recessed inward while the corresponding engagement portions 26*a* to 26*c* provided to the inner side surfaces 27*c* and 27*d* of the housing 20 may be, for example, protruding portions that protrude outward.

Moreover, for example, the above embodiment illustrates an example of application to an electrical cable. However, the configuration of the present disclosure can also be applied to, for example, an optical fiber cable. In this manner, the drawings and description of the present application are mere exemplifications, and the present disclosure is not limited to them.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A cable connector comprising:

a housing; and a cable holder capable of holding one end side of a cable, wherein the cable holder includes at least three first to third engagement portions on each of opposing outer side surfaces, in a direction along a lead-out direction where the cable held on the one end side by the cable holder is led out from the cable holder, the first engagement portion is placed on a side far from the cable lead-out side of the cable holder, the second engagement portion is placed on a side near the lead-out side, and the third engagement portion is placed between the first engagement portion and the second engagement portion, the housing includes at least three first to third corresponding engagement portions capable of engaging respectively with the first to third engagement portions, on each of opposing inner side surfaces, it is configured in such a manner that, upon the first to third engagement portions engaging with the first to third corresponding engagement portions, respectively, the cable holder is capable of being placed at least at a first engagement position and a second engagement position with respect to the housing, the cable holder moves from the first engagement position to the second engagement position with respect to the housing in an engagement direction that is perpendicular to the lead-out direction, at the first engagement position, the first and second engagement portions are in engagement with the first and second corresponding engagement portions, respectively, while the third engagement portion has not yet engaged with the third corresponding engagement portion, and at the second engagement position, all the first to third engagement portions are in engagement with the first to third corresponding engagement portions, respectively.

2. The cable connector according to claim 1, wherein the first to third engagement portions are first to third protruding portions protruding outward, or first to third recessed portions recessed inward, the first to third corresponding engagement portions are the first to third recessed portions recessed inward, or the first to third protruding portions protruding outward, respectively, and the first to third engagement portions, together with the first to third corresponding engagement portions, configure combinations of the recessed portion and the protruding portion.

3. The cable connector according to claim 2, wherein the cable holder is capable of being mounted in such a manner as to be rotatable with respect to the housing on the basis of the engagement of the second engagement portion and the second corresponding engagement portion before being located at the first engagement position with respect to the housing.

4. The cable connector according to claim 3, wherein the second engagement portion is the second protruding portion protruding outward from the outer side surface of the cable holder, the second corresponding engagement portion is the second recessed portion recessed inward in the inner side surface of the housing, the inner side surface of the housing is provided with a recessed guide groove for guiding the second protruding portion to the second recessed portion, the recessed guide groove extends from an edge of the housing to the second recessed portion formed as the second corresponding engagement portion, along a direction crossing a direction along the engagement direction from the first engagement position to the second engagement position, upon guiding the second protruding portion to the second recessed portion along the recessed guide groove, the second protruding portion engages with the recessed guide groove in such a manner that an angle formed by the direction along the lead-out direction and the direction along the engagement direction maintains an acute angle or a substantially right angle, an end portion, which is located on the second recessed portion side, of the second protruding portion in the engaged state is provided with a taper, and the taper is tapered toward the second recessed portion in such a manner as to increasingly reduce a distance between the opposing inner side surfaces, and/or a path for the taper in the recessed guide groove is increasingly narrowed toward the second recessed portion in the relationship with the taper.

5. The cable connector according to claim 4, wherein the direction along the lead-out direction and the direction along the engagement direction cross each other upon the cable holder being located at the first or second engagement position with respect to the housing.

6. The cable connector according to claim 1, wherein the first corresponding engagement portion includes a temporary fastening portion that temporarily fastens the first engagement portion upon the cable holder being located at the first engagement position with respect to the housing, and a first fixing portion that fixes the first engagement portion upon the cable holder being located at the second engagement position with respect to the housing, the temporary fastening portion and the first fixing portion are spaced apart from each other in the direction along the engagement direction, the second corresponding engagement portion is a slide portion that extends continuously along the engagement direction in such a manner as to allow the second engagement portion to slide between a position of engaging with the second engagement portion upon the cable holder being located at the first engagement position with respect to the housing and a position of engaging with the second engagement portion upon the cable holder being located at the second engagement position with respect to the housing, the third corresponding engagement portion includes a third fixing portion that fixes the third engagement portion upon the cable holder being located at the second engagement position with respect to the housing, and an edge portion of the housing extending in the direction crossing the direction along the engagement direction acts as the third corresponding engagement portion upon the cable holder being located at the first engagement position with respect to the housing.

7. The cable connector according to claim 1, wherein the housing further includes a cable pressure-welding portion that pressure-welds the cable held on the one end side by the cable holder, upon the cable holder being located at the first engagement position with respect to the housing, the third engagement portion is located in such a manner as to be placed at a position corresponding to the cable pressure-welding portion in the direction along the lead-out direction, and a pressing portion that presses the cable holder against the housing is provided at least near the third engagement portion.

8. A method of manufacturing a cable connector by mounting, on a housing, a cable holder capable of holding one end side of a cable, wherein the cable holder includes at least three first to third engagement portions on each of opposing outer side surfaces, in a direction along a lead-out direction where the cable held on the one end side by the cable holder is led out from the cable holder, the first engagement portion is placed on a side far from the cable lead-out side of the cable holder, the second engagement portion is placed on a side near the lead-out side, and the third engagement portion is placed between the first engagement portion and the second engagement portion, the housing includes at least three first to third corresponding engagement portions capable of engaging respectively with the first to third engagement portions, on each of opposing inner side surfaces, it is configured in such a manner that, upon the first to third engagement portions engaging with the first to third corresponding engagement portions, respectively, the cable holder is located with respect to the housing at least at a first engagement position where the first and second engagement portions are in engagement with the first and second corresponding engagement portions, respectively, while the third engagement portion has not yet engaged with the third corresponding engagement portion, and at a second engagement position where all the first to third engagement portions are in engagement with the first to third corresponding engagement portions, the cable holder moves from the first engagement position to the second engagement position with respect to the housing in an engagement direction that is perpendicular to the lead-out direction, and the method comprises:

moving the cable holder along a direction crossing a direction along the engagement direction from the first engagement position to the second engagement position with respect to the housing in a state where the second engagement portion is in engagement with the second corresponding engagement portion in such a manner that an angle formed by the direction along the lead-out direction and the direction along the engagement direction maintains an acute angle or a right angle;

rotating the cable holder about the second engagement portion with respect to the housing and accordingly locating the cable holder at the first engagement position; and then pressing the cable holder against the housing and accordingly locating the cable holder at the second engagement position.

9. A cable connector comprising:

a housing; and a cable holder capable of holding one end side of a cable, wherein the cable holder includes at least three first to third engagement portions on each of opposing outer side surfaces, in a direction along a lead-out direction where the cable held on the one end side by the cable holder is led out from the cable holder, the first engagement portion is placed on a side far from the cable lead-out side of the cable holder, the second engagement portion is placed on a side near the lead-out side, and the third engagement portion is placed between the first engagement portion and the second engagement portion, the housing includes at least three first to third corresponding engagement portions capable of engaging respectively with the first to third engagement portions, on each of opposing inner side surfaces, it is configured in such a manner that, upon the first to third engagement portions engaging with the first to third corresponding engagement portions, respectively, the cable holder is capable of being placed at least at a first engagement position and a second engagement position with respect to the housing, at the first engagement position, the first and second engagement portions are in engagement with the first and second corresponding engagement portions, respectively, while the third engagement portion has not yet engaged with the third corresponding engagement portion, at the second engagement position, all the first to third engagement portions are in engagement with the first to third corresponding engagement portions, respectively, the first to third engagement portions are first to third protruding portions protruding outward, or first to third recessed portions recessed inward, the first to third corresponding engagement portions are the first to third recessed portions recessed inward, or the first to third protruding portions protruding outward, respectively, the first to third engagement portions, together with the first to third corresponding engagement portions, configure combinations of the recessed portion and the protruding portion, the cable holder is capable of being mounted in such a manner as to be rotatable with respect to the housing on the basis of the engagement of the second engagement portion and the second corresponding engagement portion before being located at the first engagement position with respect to the housing, the second engagement portion is the second protruding portion protruding outward from the outer side surface of the cable holder, the second corresponding engagement portion is the second recessed portion recessed inward in the inner side surface of the housing, the inner side surface of the housing is provided with a recessed guide groove for guiding the second protruding portion to the second recessed portion, the recessed guide groove extends from an edge of the housing to the second recessed portion formed as the second corresponding engagement portion, along a direction crossing a direction along an engagement direction from the first engagement position to the second engagement position, upon guiding the second protruding portion to the second recessed portion along the recessed guide groove, the second protruding portion engages with the recessed guide groove in such a manner that an angle formed by the direction along the lead-out direction and the direction along the engagement direction maintains an acute angle or a substantially right angle, an end portion, which is located on the second recessed portion side, of the second protruding portion in the engaged state is provided with a taper, and the taper is tapered toward the second recessed portion in such a manner as to increasingly reduce a distance between the opposing inner side surfaces, and/or a path for the taper in the recessed guide groove is increasingly narrowed toward the second recessed portion in the relationship with the taper.

10. The cable connector according to claim 9, wherein the direction along the lead-out direction and the direction along the engagement direction cross each other upon the cable holder being located at the first or second engagement position with respect to the housing.

11. The cable connector according to claim 9, wherein the first corresponding engagement portion includes a temporary fastening portion that temporarily fastens the first engagement portion upon the cable holder being located at the first engagement position with respect to the housing, and a first fixing portion that fixes the first engagement portion upon the cable holder being located at the second engagement position with respect to the housing, the temporary fastening portion and the first fixing portion are spaced apart from each other in the direction along the engagement direction, the second corresponding engagement portion is a slide portion that extends continuously along the engagement direction in such a manner as to allow the second engagement portion to slide between a position of engaging with the second engagement portion upon the cable holder being located at the first engagement position with respect to the housing and a position of engaging with the second engagement portion upon the cable holder being located at the second engagement position with respect to the housing, the third corresponding engagement portion includes a third fixing portion that fixes the third engagement portion upon the cable holder being located at the second engagement position with respect to the housing, and an edge portion of the housing extending in the direction crossing the direction along the engagement direction acts as the third corresponding engagement portion upon the cable holder being located at the first engagement position with respect to the housing.

12. The cable connector according to claim 9, wherein the housing further includes a cable pressure-welding portion that pressure-welds the cable held on the one end side by the cable holder, upon the cable holder being located at the first engagement position with respect to the housing, the third engagement portion is located in such a manner as to be placed at a position corresponding to the cable pressure-welding portion in the direction along the lead-out direction, and a pressing portion that presses the cable holder against the housing is provided at least near the third engagement portion.

13. A method of manufacturing the cable connector of claim 9 by mounting, on the housing, the cable holder capable of holding one end side of the cable, the method comprises:

moving the cable holder along a direction crossing a direction along the engagement direction from the first engagement position to the second engagement position with respect to the housing in a state where the second engagement portion is in engagement with the second corresponding engagement portion in such a manner that an angle formed by the direction along the lead-out direction and the direction along the engagement direction maintains an acute angle or a right angle;

rotating the cable holder about the second engagement portion with respect to the housing and accordingly locating the cable holder at the first engagement position; and then pressing the cable holder against the housing and accordingly locating the cable holder at the second engagement position.

* * * * *